US010808532B2

(12) United States Patent
Kawai et al.

(10) Patent No.: US 10,808,532 B2
(45) Date of Patent: Oct. 20, 2020

(54) TUNNEL BORING MACHINE

(71) Applicant: KOMATSU LTD., Minato-ku, Tokyo (JP)

(72) Inventors: Kazunari Kawai, Tokyo (JP); Shinichi Terada, Tokyo (JP); Eiichi Morioka, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 16/090,331

(22) PCT Filed: Apr. 24, 2017

(86) PCT No.: PCT/JP2017/016166
§ 371 (c)(1),
(2) Date: Oct. 1, 2018

(87) PCT Pub. No.: WO2017/199693
PCT Pub. Date: Nov. 23, 2017

(65) Prior Publication Data

US 2019/0112924 A1 Apr. 18, 2019

(30) Foreign Application Priority Data

May 17, 2016 (JP) ..... 2016-098975

(51) Int. Cl.
*E21D 9/11* (2006.01)
*E21D 9/00* (2006.01)
*E21D 9/10* (2006.01)

(52) U.S. Cl.
CPC ..... *E21D 9/003* (2013.01); *E21D 9/104* (2013.01); *E21D 9/1006* (2013.01); *E21D 9/11* (2013.01); *E21D 9/112* (2013.01)

(58) Field of Classification Search
CPC ..... E21D 9/087; E21D 9/1006; E21D 9/10; E21D 9/104; E21D 9/11; E21D 9/112; E21D 9/003; E01C 23/088; E01C 23/127
See application file for complete search history.

(56) References Cited

U.S. PATENT DOCUMENTS 5,106,163 A * 4/1992 Fujiwara ..... E21D 9/003 175/40
7,014,271 B2 3/2006 Burger et al.
(Continued)

FOREIGN PATENT DOCUMENTS

CN 103874828 A 6/2014
JP H06-102029 A 4/1994
(Continued)

OTHER PUBLICATIONS

English language machine translation of Michinao, Japanese Patent Publication No. JP-H0941863-A, published Feb. 10, 1997 (8 pages) (Year: 1997).*

*Primary Examiner* — Janine M Kreck
*Assistant Examiner* — Michael A Goodwin
(74) *Attorney, Agent, or Firm* — Faegre Drinker Biddle & Reath LLP

(57) ABSTRACT

Provided is a tunnel boring machine that can detect a wear condition of a disc cutter with a highly reliable configuration. The tunnel boring machine includes a measurement device. The measurement device is disposed behind the disc cutter mounted on a cutter head. The measurement device has a function as an acquisition unit that acquires cutting edge position data indicating a position of a cutting edge part of a cutter ring in the disc cutter. The tunnel boring machine further includes a DC discrimination unit that discriminates which one of a plurality of disc cutters is the disc cutter the cutting edge position data of which is acquired by the
(Continued)

measurement device and a wear amount calculator that calculates a wear amount of the cutting edge part of the discriminated disc cutter.

16 Claims, 15 Drawing Sheets

(56) References Cited

U.S. PATENT DOCUMENTS

| | | | | |
|---|---|---|---|---|
| 9,181,800 | B2 | 11/2015 | Edelmann et al. | |
| 2005/0023882 | A1* | 2/2005 | Burger | E21D 9/003 299/1.8 |
| 2009/0297273 | A1* | 12/2009 | Lindbergh | E21D 9/003 405/138 |
| 2011/0031017 | A1* | 2/2011 | Iwata | E21B 12/02 175/40 |
| 2012/0256470 | A1* | 10/2012 | von Schoenebeck | E01C 23/088 299/10 |
| 2014/0232167 | A1* | 8/2014 | Edelmann | E21D 9/104 299/1.3 |
| 2014/0324364 | A1* | 10/2014 | Wagner | B28D 7/00 702/34 |

FOREIGN PATENT DOCUMENTS

| | | | | |
|---|---|---|---|---|
| JP | H0941863 | A | * | 2/1997 |
| JP | H10-140981 | A | | 5/1998 |
| JP | 2003-82986 | A | | 3/2003 |
| JP | 2003-307095 | A | | 10/2003 |
| JP | 2008-202321 | A | | 9/2008 |

* cited by examiner

TUNNEL BORING MACHINE

TECHNICAL FIELD

The present invention relates to a tunnel boring machine.

BACKGROUND ART

An entire section tunnel boring machine includes a main body propelled in the ground and a cutter head disposed in front of the main body. Rotation of the cutter head relative to a central axis of the main body can be performed by an electric motor or a hydraulic actuator along with the propulsion of the main body. A plurality of disc cutters are attached to the cutter head in the case where bedrock or gravel is excavated. The disc cutter is pushed into the bedrock along with the propulsion of the main body. In association with the rotation of the cutter head, the disc cutter rotates with respect to the cutter head to excavate the bedrock.

When a cutting edge of the disc cutter is worn as a result of the excavation, excavation performance is degraded. Conventionally, a wear condition of the disc cutter is measured by manual work of a worker. However, it is necessary to stop the tunnel boring machine during this work, which results in a problem in that operation efficiency is degraded. For this reason, for example, Japanese Patent Laying-Open No. 2003-82986 (PTL 1) proposes a technique, in which a non-contact distance sensor is provided in each of the disc cutters provided in the rotatable cutter head and the wear condition of the disc cutter is detected from a detection signal of the distance sensor.

CITATION LIST

Patent Literature

PTL 1: Japanese Patent Laying-Open No 2003-82986

SUMMARY OF INVENTION

Technical Problem

In the technique described in PTL 1, a large number of sensors for a large number of disc cutters provided in the rotatable cutter head are connected to a control device provided in the fixed main body through wiring. A coupling unit that connects a rotating side and a fixed side is required in the wiring, and a structure of the coupling unit becomes complicated, so that difficulty is easily generated in reliability. Additionally, it is necessary to provide the sensor in each disc cutter, so that there is also a cost problem.

An object of the present invention is to provide a tunnel boring machine that can detect a wear condition of the disc cutter with a highly reliable configuration.

Solution to Problem

According to one aspect of the present invention, a tunnel boring machine includes a main body, a cutter head, a plurality of disc cutters, an acquisition unit, a discrimination unit, and a calculator. The cutter head is disposed in front of the main body. The cutter head is rotatable with respect to the main body. The plurality of disc cutters are rotatably mounted on the cutter head. Each of the plurality of disc cutters has a cutter ring. The cutter ring is exposed to a front surface of the cutter head while exposed to a back surface of the cutter head. Each cutter ring includes a cutting edge part. The acquisition unit acquires cutting edge position data indicating a position of the cutting edge part of the cutter ring. The acquisition unit is disposed behind the plurality of disc cutters. The discrimination unit discriminates which one of the plurality of disc cutters is the disc cutter the cutting edge position data of which is acquired by the acquisition unit. The calculator calculates a wear amount of the cutting edge part of the disc cutter discriminated by the discrimination unit based on the cutting edge position data of the discriminated disc cutter.

According to one aspect of the present invention, a tunnel boring machine includes a main body, a cutter head, a plurality of disc cutters, an acquisition unit, and a discrimination unit. The cutter head is disposed in front of the main body. The cutter head is rotatable with respect to the main body. The plurality of disc cutters are rotatably mounted on the cutter head. Each of the plurality of disc cutters has a cutter ring. The cutter ring is exposed to a front surface of the cutter head while exposed to a back surface of the cutter head. The acquisition unit acquires rotation data indicating presence or absence of rotation of the disc cutter with respect to the cutter head. The acquisition unit is disposed behind the plurality of disc cutters. The discrimination unit discriminates which one of the plurality of disc cutters is the disc cutter the rotation data of which is acquired by the acquisition unit.

According to one aspect of the present invention, a tunnel boring machine includes a main body, a cutter head, a plurality of disc cutters, an acquisition unit, a discrimination unit, and a calculator. The cutter head is disposed in front of the main body. The cutter head is rotatable with respect to the main body. The plurality of disc cutters are rotatably mounted on the cutter head. Each of the plurality of disc cutters has a cutter ring. The cutter ring is exposed to a front surface of the cutter head while exposed to a back surface of the cutter head. Each cutter ring includes a cutting edge part. The acquisition unit acquires cutting edge position data indicating a position of the cutting edge part of the cutter ring and rotation data indicating presence or absence of rotation of the disc cutter with respect to the cutter head. The acquisition unit is disposed behind the plurality of disc cutters. The discrimination unit discriminates which one of the plurality of disc cutters is the disc cutter the cutting edge position data and the rotation data of which are acquired by the acquisition unit. The calculator calculates a wear amount of the cutting edge part of the disc cutter discriminated by the discrimination unit based on the cutting edge position data of the discriminated disc cutter.

Advantageous Effects of Invention

According to the present invention, the wear condition of the disc cutter can be detected with the highly reliable configuration.

DESCRIPTION OF EMBODIMENTS

Hereinafter, embodiments of the present invention will be described with reference to the drawings.

A configuration of a tunnel boring machine to which the idea of the present invention is easily applicable will be described.

First Embodiment

Figure 1:
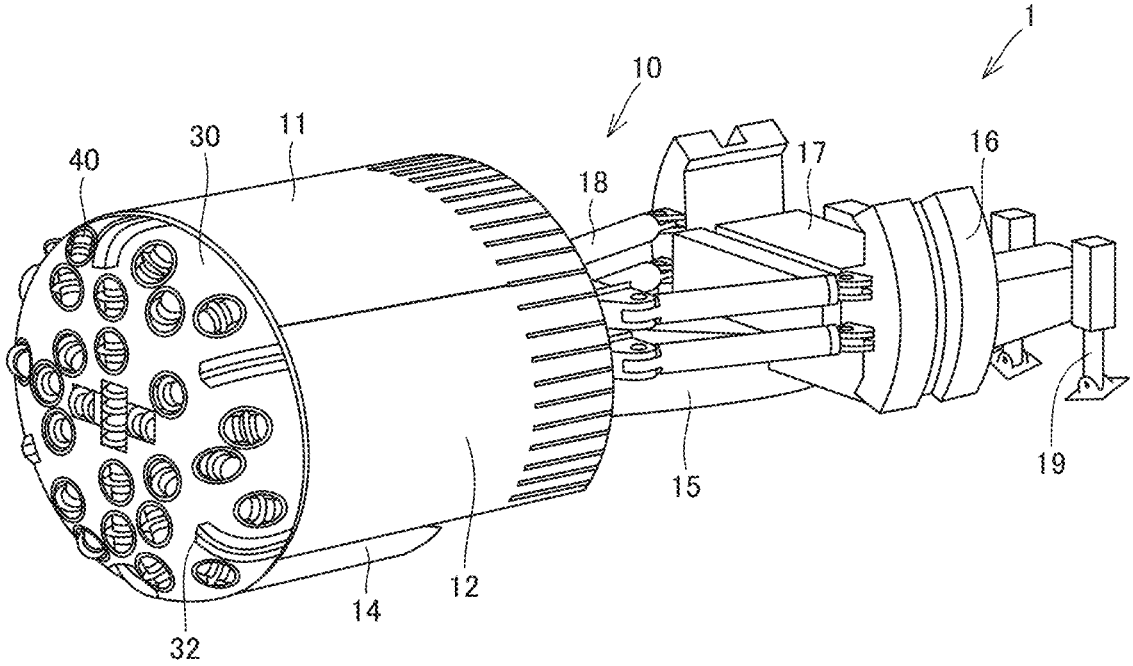
FIG. 1 is a perspective view schematically illustrating a configuration of a tunnel boring machine according to a first embodiment.

FIG. 1 is a perspective view schematically illustrating a configuration of a tunnel boring machine 1 according to a first embodiment. As illustrated in FIG. 1, tunnel boring machine 1 includes a main body 10 and a cutter head 30 that excavates underground.

Main body 10 includes a roof support 11, a side support 12, a vertical support 14, and a main beam 15. Main beam 15 extends in a fore/aft direction that is a boring direction of tunnel boring machine 1. Roof support 11 is disposed above main beam 15. Side support 12 is disposed in a side of main beam 15. Vertical support 14 is disposed below main beam 15. A front end of main beam 15 is disposed in a space surrounded by roof support 11, side support 12, and vertical support 14.

Main body 10 also includes a gripper shoe 16, a gripper carrier 17, a thrust jack 18 and a rear support 19. Gripper carrier 17 is provided behind roof support 11, side support 12, and vertical support 14, and is slidable along main beam 15.

Two gripper shoes 16 are respectively provided both sides of gripper carrier 17. Gripper shoe 16 is constructed so as to be able to be pressed against a sidewall of a tunnel by an expanding and retracting operation of a gripper jack (not illustrated) held by gripper carrier 17. One end of thrust jack 18 is attached to main beam 15. The other end of thrust jack 18 is attached to gripper shoe 16. Thrust jack 18 is configured to be expandable and retractable in the fore/aft direction. Gripper carrier 17 is configured to slide along main beam 15 by expansion and retraction of thrust jack 18.

Rear support 19 supports main beam 15 at a rear end of main beam 15. Rear support 19 is provided so as to be able to come into contact with a bottom surface of the tunnel by the expanding and retracting operation of a rear support cylinder.

Cutter head 30 is disposed in front of main body 10, and is supported so as to be rotatable with respect to main body 10 and so as to be movable integrally with main body 10 in the fore/aft direction. A plurality of disc cutters 40 are mounted on cutter head 30. Disc cutter 40 is supported so as to be rotatable with respect to cutter head 30. By forward movement of main body 10 and cutter head 30, disc cutter 40 is pressed against an excavation surface in a tunnel boring direction, disc cutter 40 rotates in association with the rotation of cutter head 30 to crush a rock, and the excavation surface is excavated. A waste rocks generated by excavation is scooped up by a scraper bucket 32, and carried out rearward by a belt conveyer (not illustrated in FIG. 1).

Figure 2:
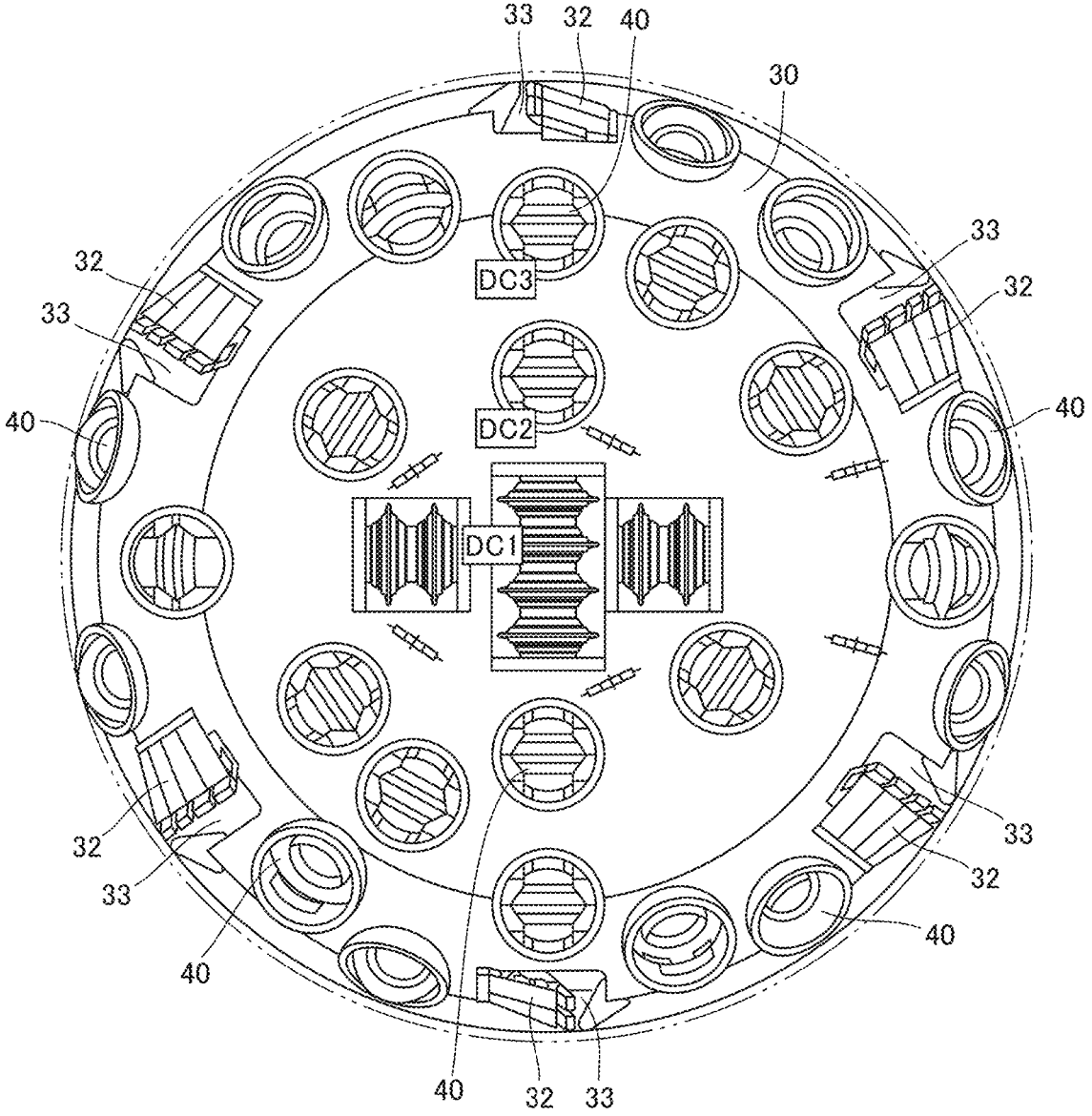
FIG. 2 is a front view illustrating the tunnel boring machine of the first embodiment.

FIG. 2 is a front view illustrating tunnel boring machine 1 of the first embodiment. As illustrated in FIG. 2, 32 disc cutters 40 are mounted on cutter head 30 of the present embodiment.

In FIG. 2, three disc cutters 40 out of 32 disc cutters 40 are numbered DC1, DC2, DC3. In a direction in which three numbered disc cutters 40 are arranged, disc cutter 40 of DC1 is disposed closest to the center of cutter head 30 in three disc cutters 40, and disc cutter 40 of DC3 is disposed farthest from the center of cutter head 30.

Six scraper buckets 32 are provided on a circumferential edge of cutter head 30. Six taking ports 33 are formed adjacent to scraper bucket 32 in order to take the waste rocks scraped by scraper bucket 32 into the machine. Cutter head 30 rotates in a counterclockwise direction in FIG. 2, and scraper bucket 32 is disposed on a rear side in the rotation direction of cutter head 30 with respect to taking port 33.

Figure 3:
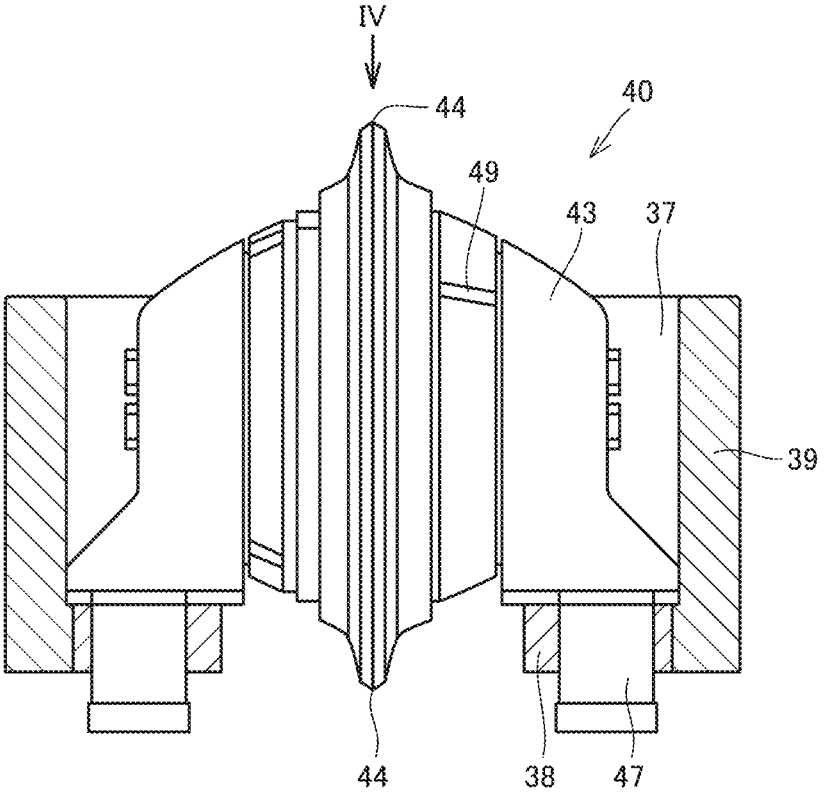
FIG. 3 is a partially sectional view of a disc cutter.
Figure 4:
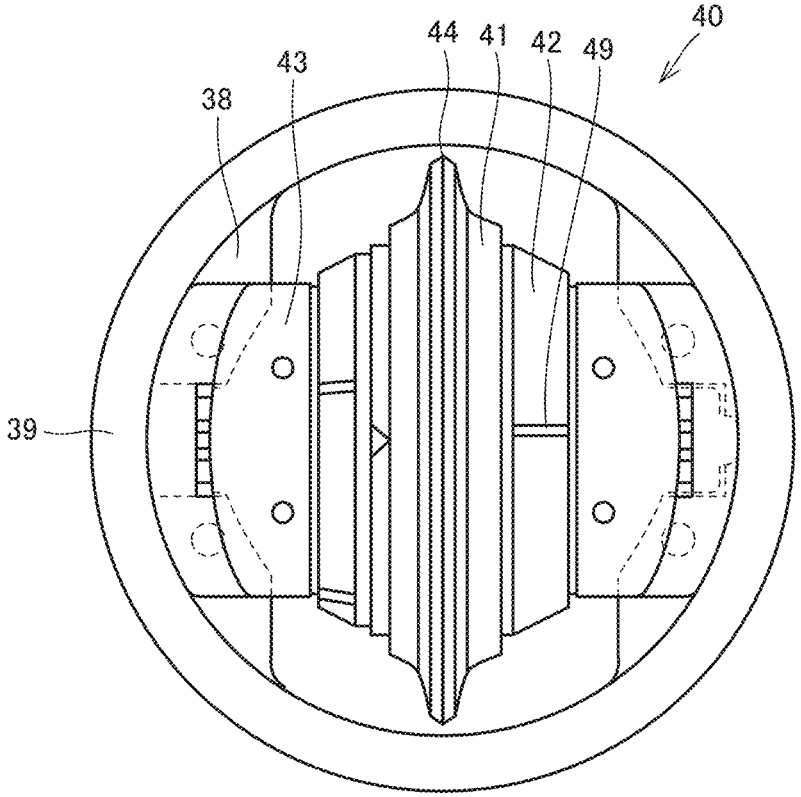
FIG. 4 is a front view of the disc cutter.

FIG. 3 is a partially sectional view of disc cutter 40. FIG. 4 is a front view of disc cutter 40. FIG. 4 illustrates disc cutter 40 when viewed from the direction of an arrow IV in FIG. 3. Disc cutter 40 includes a hub 42 formed into a substantially cylindrical shape and a cutter ring 41 attached to an outer circumferential surface of a central portion of hub 42.

Cutter head 30 includes a hollow, cylindrical accommodation unit 39 in which an accommodation space 37 that accommodates disc cutter 40 is formed and a fixture 38 that fixes disc cutter 40. A pair of retainers 43 is fixed to fixture 38 using a fixing member 47 such as a bolt. A fixed shaft (not illustrated) is supported by the pair of retainers 43. Cutter ring 41 and hub 42 are rotatably supported with respect to the fixed shaft with a bearing (not illustrated) interposed therebetween. Hub 42 is configured to be rotatable integrally with cutter ring 41. Cutter ring 41 is fitted in hub 42.

Cutter ring 41 includes a cutting edge part 44. Cutter ring 41 is a member that is pressed against the excavation surface of the tunnel to excavate the excavation surface in disc cutter 40. Cutter ring 41 is rotatably mounted on cutter head 30. As illustrated in FIG. 3, cutting edge part 44 projects from accommodation unit 39 of cutter head 30 in both up and down directions. Cutting edge part 44 projects forward with respect to cutter head 30, and projects rearward with respect to cutter head 30. Cutting edge part 44 is exposed to a front surface of cutter head 30 while exposed to a back surface of cutter head 30.

A marking 49 is formed on hub 42. For example, marking 49 is a slit in which the surface of hub 42 is recessed like a groove or a projection in which the surface of hub 42 projects into a ridge shape. A special fluorescent agent may be applied to the inside of the slit. Marking 49 is formed at least one place in the circumferential direction of the rotation of hub 42. Marking 49 may be formed on both sides of hub 42 with cutter ring 41 sandwiched therebetween.

Figure 5:
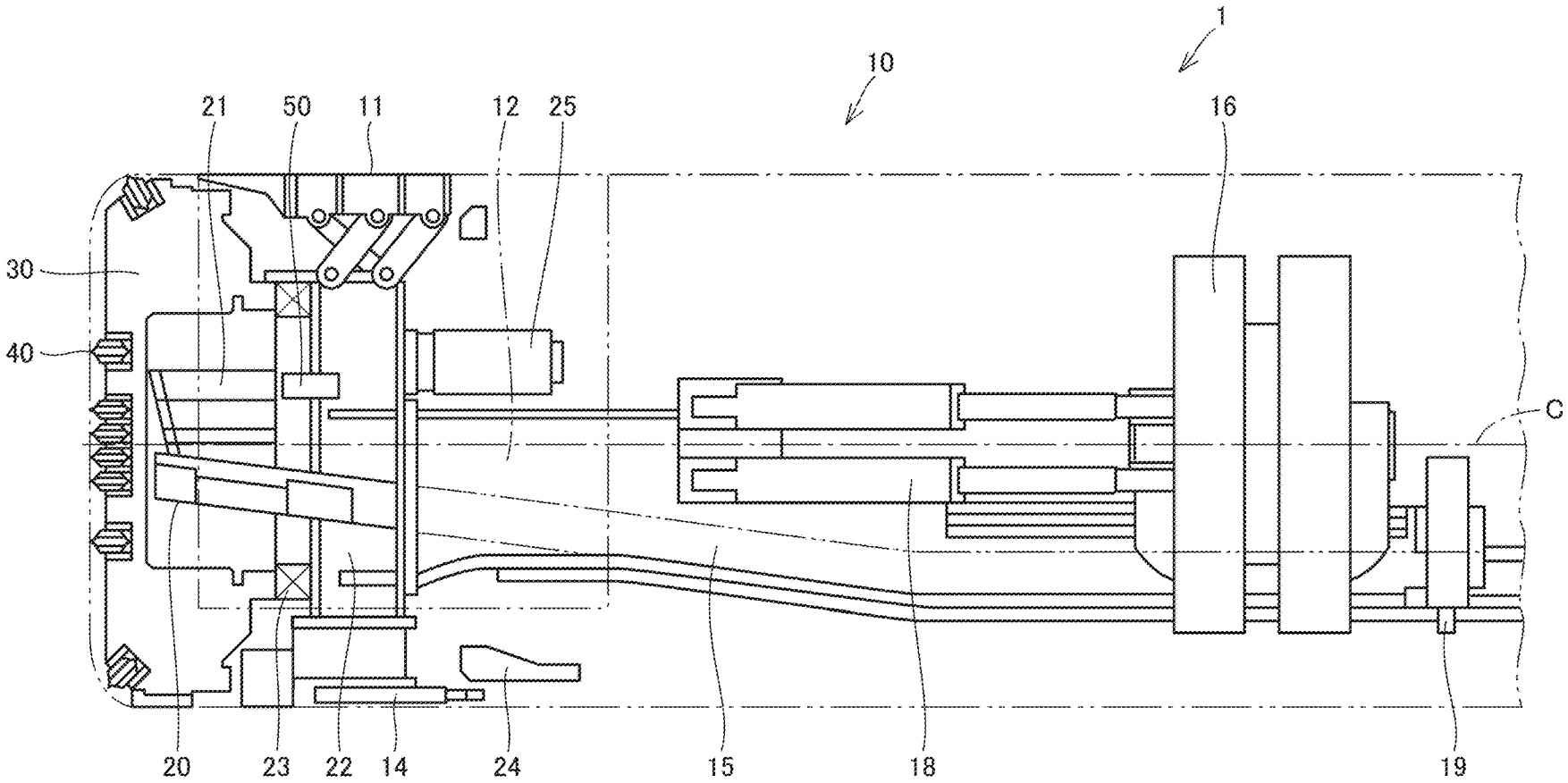
FIG. 5 is a side view schematically illustrating an internal structure of the tunnel boring machine.

FIG. 5 is a side view schematically illustrating an internal structure of tunnel boring machine 1. As illustrated in FIG. 5, main body 10 of tunnel boring machine 1 includes a belt conveyor 20, a hopper chute 21, a cutter head support 22, a main bearing 23, an erector 24, a cutter head driving motor 25, and a measurement device 50.

Main beam 15 is formed into a hollow shape. Belt conveyor 20 is disposed in main beam 15. Belt conveyor 20 is a device that conveys the waste rocks excavated by disc cutter 40 rearward. Hopper chute 21 is provided above a front end of belt conveyor 20. Hopper chute 21 is a device that receives the waste rocks scraped by scraper bucket 32 and guides the waste rocks onto belt conveyor 20.

Cutter head support 22 is fixed to the front end of main beam 15. Cutter head 30 is rotatably supported by cutter head support 22 with main bearing 23 interposed therebetween. Erector 24 is disposed on the rear side of cutter head support 22. Cutter head driving motor 25 is attached to cutter head support 22.

Measurement device 50 is also attached to cutter head support 22. Measurement device 50 is attached to main body 10 of tunnel boring machine 1. Measurement device 50 is disposed behind cutter head 30. Measurement device 50 is disposed behind the plurality of disc cutters 40. Measurement device 50 is disposed behind hopper chute 21. Measurement device 50 can measure disc cutter 40 from behind. Measurement device 50 may have a function as a data acquisition unit that acquires data of disc cutter 40. In the case where an imaging device is used as measurement device 50, measurement device 50 also measures a part of cutter head 30. In the case where the imaging device is used as measurement device 50, the imaging device can capture images of a part of cutter head 30 and at least two disc cutters 40 out of the plurality of disc cutters 40 from behind.

Figure 6:
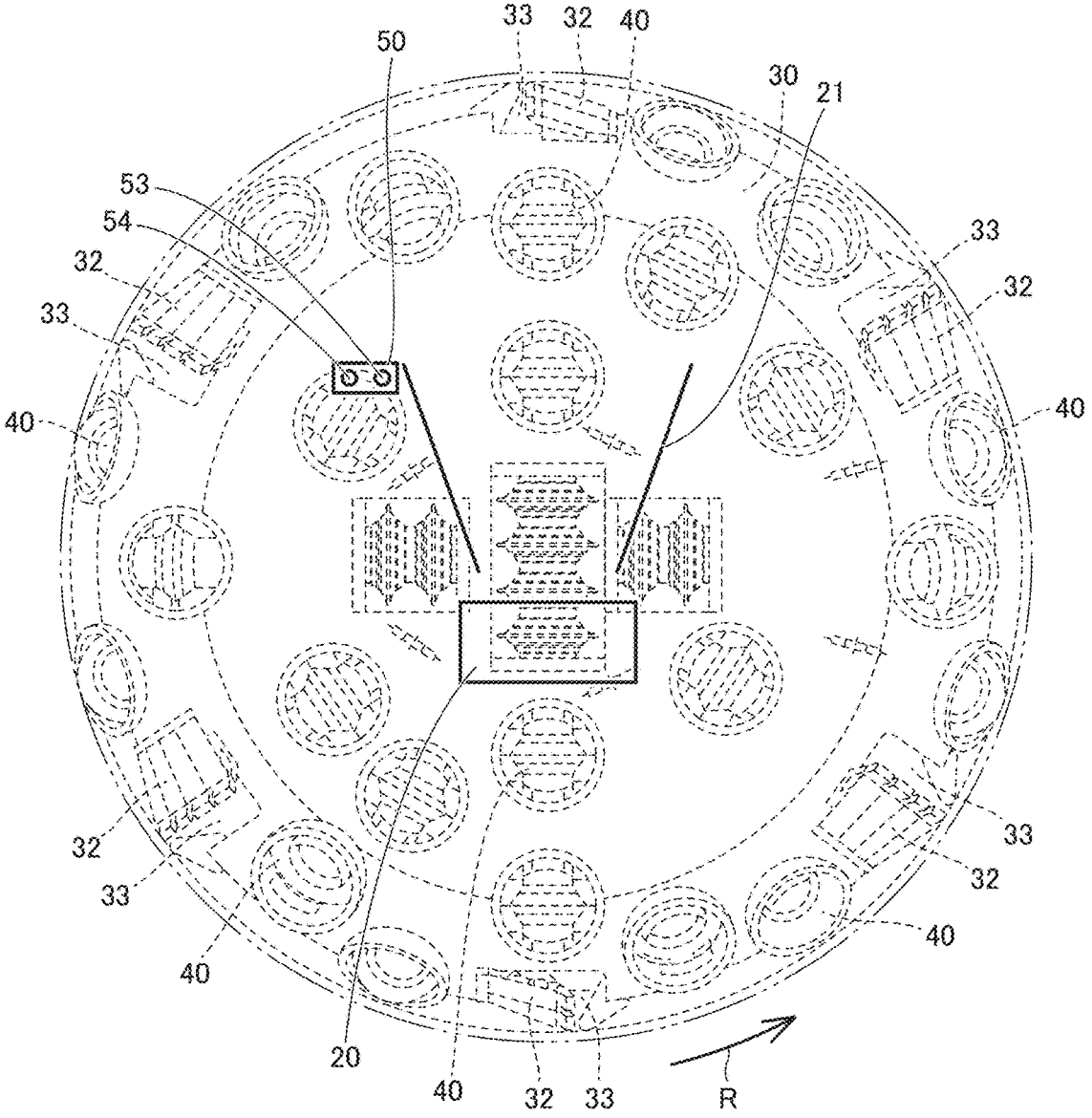
FIG. 6 is a schematic diagram illustrating disposition of a measurement device in the tunnel boring machine when viewed from the front.

FIG. 6 is a schematic diagram illustrating the disposition in the case where a stereo camera is used as measurement device 50 in tunnel boring machine 1 when viewed from the front. In FIG. 6, cutter head 30 and 32 disc cutters 40 in FIG. 2 are indicated by a broken line and belt conveyor 20, hopper chute 21, and measurement device 50 are indicated by a solid line. An example of the case where the imaging device that is the stereo camera is used as the measurement device will be illustrated below.

Measurement device 50 (imaging device) includes a first imager 53 and a second imager 54. First imager 53 and second imager 54 are synchronized with each other, and constitute the stereo camera. First imager 53 and second imager 54 are disposed at the same height. First imager 53 and second imager 54 are arranged side by side in a right and left direction. First imager 53 and second imager 54 are the same device.

Each imager includes an optical processor, a light receiving processor, and an image processor. The optical processor has a lens that condenses light. An optical axis of the imager is an axis, which passes through the center of a lens surface and is perpendicular to the lens surface. The light receiving processor includes an imaging element. For example, the imaging element is a CMOS. The imaging element includes a light receiving surface. The light receiving surface is a surface orthogonal to the optical axis of the imager. The light receiving surface has a flat, rectangular shape.

Cutter head 30 rotates by receiving driving force from cutter head driving motor 25 (FIG. 5). An arrows in FIG. 6 indicates a rotation direction R of cutter head 30. Cutter head 30 in FIG. 6 viewed from the excavation surface is rotatable counterclockwise. The imaging device is disposed on a front side in rotation direction R of cutter head 30 with respect to hopper chute 21.

The waste rocks, which is excavated by disc cutter 40 and scraped by scraper bucket 32, drops toward the hopper chute 21 when corresponding scraper bucket 32 moves above hopper chute 21. The imaging device is disposed on the front side in rotation direction R of cutter head 30 with respect to hopper chute 21, so that the waste rocks dropping onto hopper chute 21 can be prevented from disturbing the image capturing of cutter head 30 by the imaging device.

Figure 7:
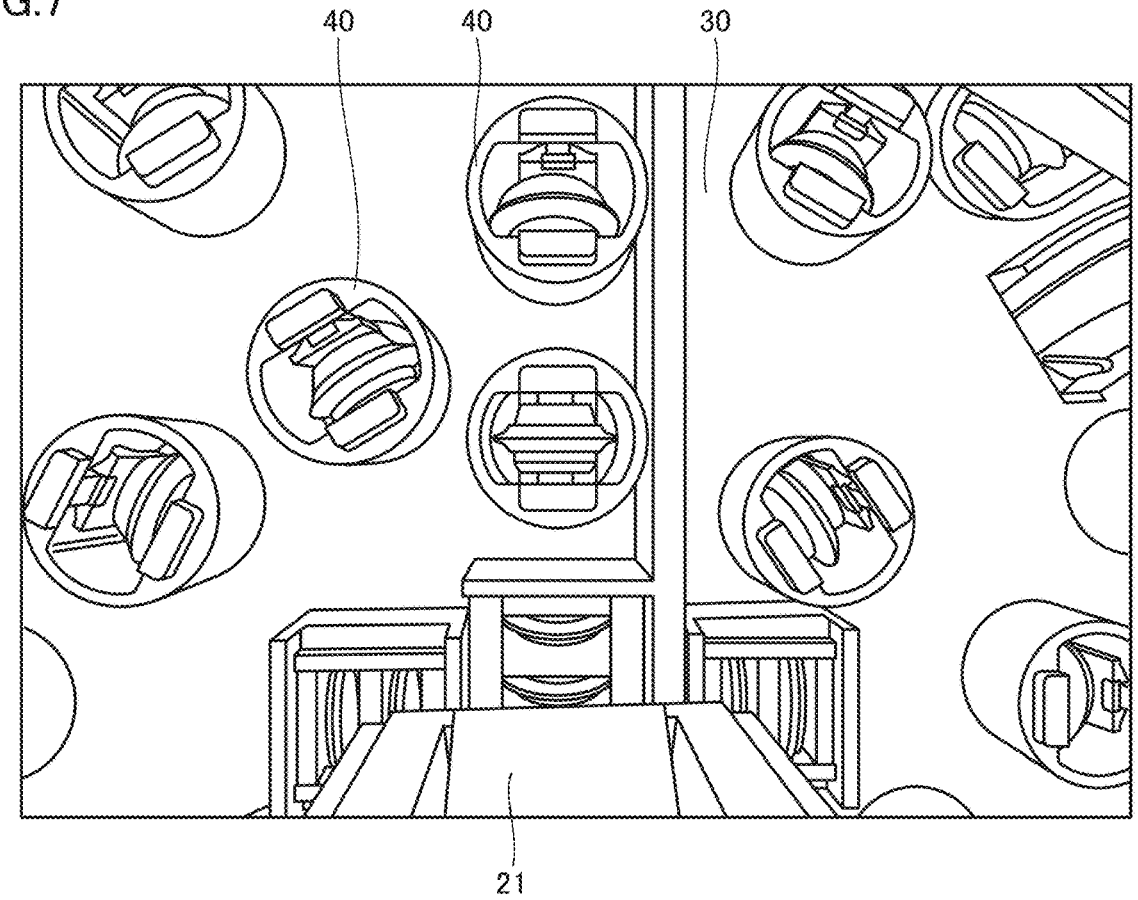
FIG. 7 is an internal view of a cutter head, and illustrates an example of image data captured by an imaging device.

FIG. 7 is an internal view of the cutter head, and illustrates an example of image data captured by the imaging device. The image data in FIG. 7 includes a part of hopper chute 21, a part of cutter head 30, and at least two disc cutters 40. The imaging device is disposed behind disc cutter 40, and captures an image of disc cutter 40 from behind. Cutting edge part 44 of cutter ring 41 of disc cutter 40 is exposed to the back surface of cutter head 30. For this reason, the image data captured by the imaging device includes cutting edge parts 44 of cutter rings 41 of the plurality of disc cutters 40.

The image data captured by the imaging device includes cutting edge position data indicating a position of cutting edge part 44 of cutter ring 41 in disc cutter 40. The imaging device has a function as an acquisition unit that acquires the pieces of cutting edge position data of at least two disc cutters 40 out of the plurality of disc cutters 40.

When the excavation surface is excavated, disc cutter 40 rotates, and changes a position relative to cutter head 30. The image data captured by the imaging device includes rotation data indicating the presence or absence of the rotation of disc cutter 40 relative to cutter head 30. The imaging device has a function as an acquisition unit that acquires the pieces of rotation data of at least two disc cutters 40 out of the plurality of disc cutters 40.

The change in position of cutting edge part 44 of cutter ring 41 in disc cutter 40 can be detected by comparing a plurality of pieces of image data captured at time intervals. Whether disc cutter 40 rotates relative to cutter head 30 can be detected by comparing the plurality of pieces of image data captured at time intervals.

In order to appropriately acquire the cutting edge position data and/or the rotation data of disc cutter 40 using the imaging device, it is necessary to compare the plurality of pieces of image data captured at time intervals with respect to identical disc cutter 40. Thus, it is necessary to discriminate which one of the plurality of disc cutters 40 is disc cutter 40 captured by the imaging device. The discrimination of disc cutter 40 will be described below.

Figure 8:
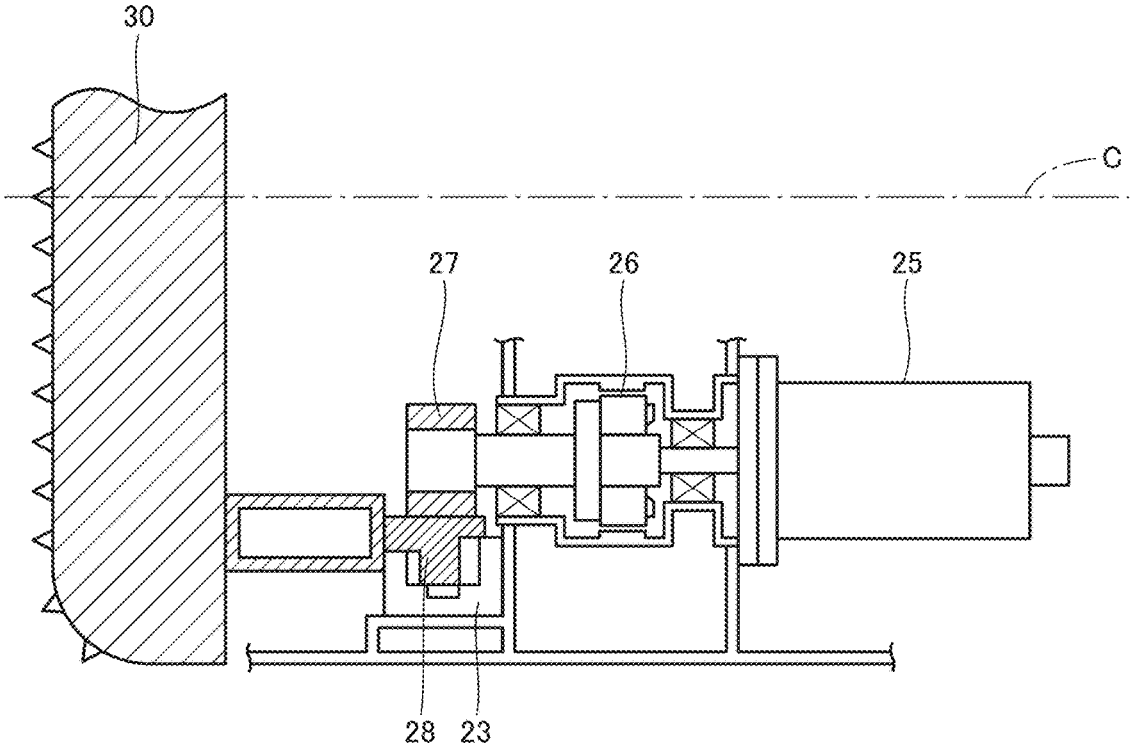
FIG. 8 is a schematic diagram illustrating a configuration of a power transmission device to the cutter head.

FIG. 8 is a schematic diagram illustrating a configuration of a power transmission device to cutter head 30. The one dot chain line in FIG. 8 indicates a center line C indicating the center of cutter head 30 or the center of tunnel boring machine 1 (see also FIG. 5).

Cutter head driving motor 25 also illustrated in FIG. 5 is coupled to an input side of a speed reducer 26. An output side of speed reducer 26 is coupled to a pinion 27. Pinion 27 engages with a gear 28. Gear 28 is rotatably supported as an inner ring of main bearing 23. Gear 28 is joined with cutter head 30.

The rotation of the cutter head driving motor 25 is transmitted to gear 28 through speed reducer 26 and pinion 27. When gear 28 rotates around center line C, cutter head 30 rotates integrally with gear 28. In this way, cutter head 30 can be rotated in a certain direction (rotation direction R in FIG. 6). For example, cutter head driving motor 25 can be constructed with an electric motor.

Figure 9:
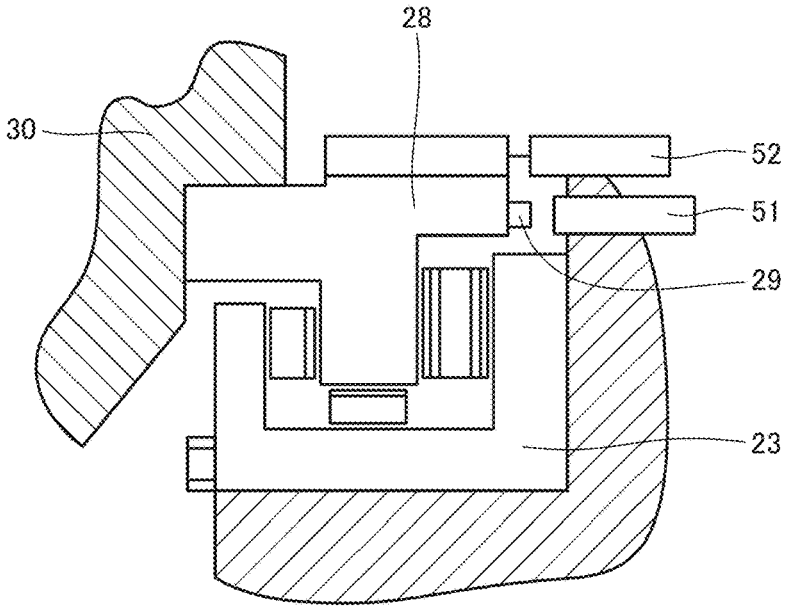
FIG. 9 is an enlarged schematic diagram illustrating a periphery of a main bearing in FIG. 8.

FIG. 9 is an enlarged schematic diagram illustrating a periphery of main bearing 23 in FIG. 8. Main bearing 23 includes a plurality of rotating bodies represented by rollers. A proximity sensor 51 and a proximity sensor 52 are attached to the housing to which main bearing 23 is attached. A projection 29 in which a part of the surface of gear 28 projects is formed on gear 28. Projection 29 is formed at one position in the rotation direction of gear 28. Proximity sensor 51 is disposed opposite projection 29. Proximity sensor 52 is disposed opposite teeth of gear 28 engaging with pinion 27.

Proximity sensor 51 detects projection 29. Proximity sensor 52 detects the teeth of gear 28. The number of passing teeth of rotating gear 28 is detected by proximity sensor 52 and the number of passing teeth of gear 28 with respect to the number of teeth of gear 28 for the rotation of 360° is calculated, which allows a rotation angle of cutter head 30 to be obtained. An angle of cutter head 30 can be defined with a position of cutter head 30 as a reference position (angle of 0°) when proximity sensor 51 detects projection 29. Accumulation of an error with respect to the rotation angle of cutter head 30 can be avoided by resetting the angle every time proximity sensor 51 detects projection 29.

The current rotation angle of cutter head 30 is recognized, and which one of the plurality of disc cutters 40 is each disc cutter 40 in the image data captured by the imaging device can be discriminated based on the previously-input attaching position of each disc cutter 40 with respect to cutter head 30 and the rotation angle of cutter head 30.

As a substitute for proximity sensors 51, 52, a rotary encoder attached to pinion 27, gear 28 or cutter head 30 may be used as the means for detecting the rotation angle of cutter head 30.

Figure 10:
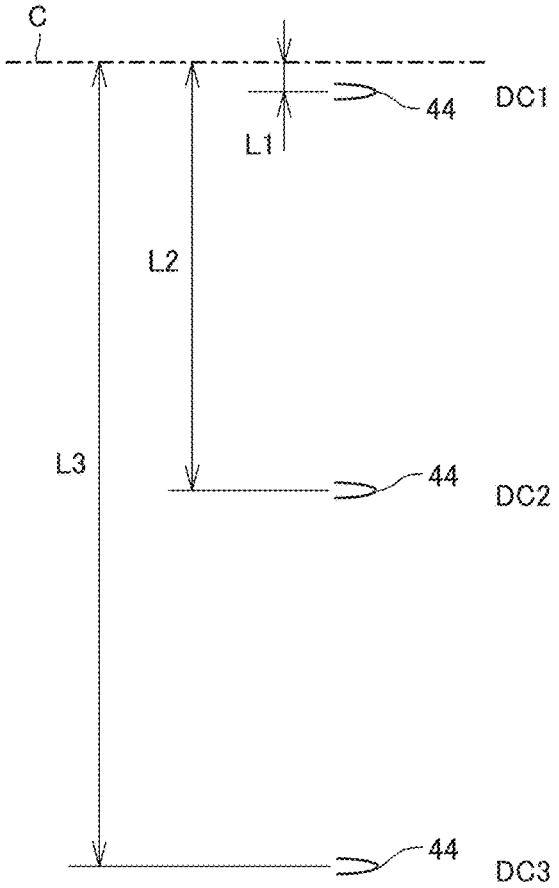
FIG. 10 is a schematic diagram illustrating a distance from a center of the cutter head to a cutting edge part of the disc cutter.

FIG. 10 is a schematic diagram illustrating a distance from the center of cutter head 30 to cutting edge part 44 of cutter ring 41 of disc cutter 40. In three disc cutters 40 of DC1, DC2, DC3 in FIG. 10 (see also FIG. 2), cutting edge part 44 of disc cutter 40 of DC1 is located closest to center line C, and cutting edge part 44 of disc cutter 40 of DC3 is located farthest from center line C. Lengths L1, L2 and L3 in FIG. 10 indicate the distance between center line C and cutting edge part 44 of three disc cutters 40 of DC 1, DC2, DC3, respectively.

When the distance from center line C of cutter head 30 to cutting edge part 44 of cutter ring 41 of disc cutter 40 can be detected, previously-input distance information about each cutting edge part 44 from center line C and the detected distance are compared to each other, which allows the discrimination which one of the plurality of disc cutters 40 is each disc cutter 40 in the image data captured by the imaging device.

As to the disposition of the plurality of disc cutters 40, all the distances from center line C of cutter head 30 to cutting edge part 44 may be different from each other, or cutting edge parts 44 of at least two disc cutters 40 may be disposed at the same distance from center line C of cutter head 30. In the latter case, which one of the plurality of disc cutters 40 is each disc cutter 40 can be discriminated based on the rotation angle of cutter head 30, or based on both the rotation angle of cutter head 30 and the distance from cutting edge part 44 to center line C.

Figure 11:
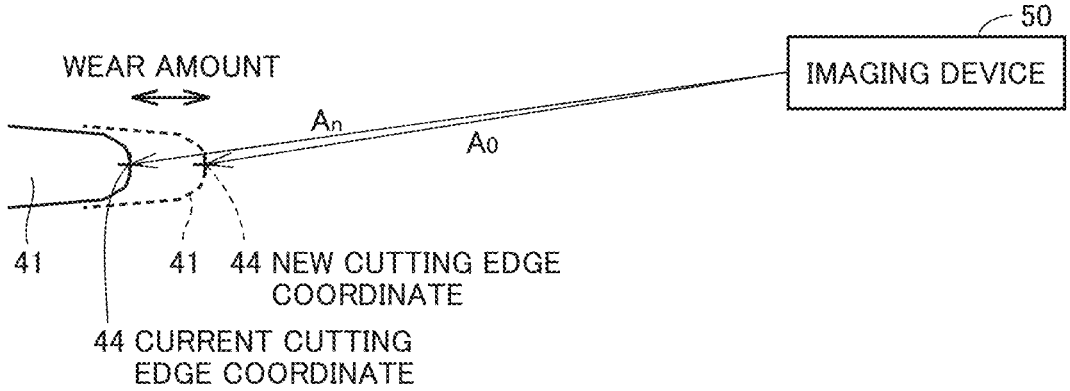
FIG. 11 is a schematic diagram illustrating an example of means for detecting a wear amount of the cutting edge part.

The detection of a wear amount of cutting edge part 44 in cutter ring 41 of each discriminated disc cutter 40 will be described below. FIG. 11 is a schematic diagram illustrating an example of means for detecting the wear amount of cutting edge part 44. FIG. 11 schematically illustrates the imaging device and a part of cutter ring 41 of disc cutter 40 that is a target for detecting the wear amount of cutting edge part 44. Cutter ring 41 indicated by a broken line illustrates new cutter ring 41. Cutter ring 41 indicated by a solid line illustrates cutter ring 41 in which cutting edge part 44 is worn after a lapse of time.

In the imaging device, each of first imager 53 and second imager 54 in FIG. 6 captures a two-dimensional image. The distance between the imaging device and cutting edge part 44 of cutter ring 41 that is an imaging target is calculated by stereo matching of the two-dimensional images simultaneously captured from different angles by first imager 53 and second imager 54. More specifically, based on a parallax between first imager 53 and second imager 54, the distance from the imaging device to cutting edge part 44 is obtained using a principle of triangulation.

By excavating the excavation surface, cutting edge part 44 is worn and the position of cutting edge part 44 varies. The imaging device can detect both the position of cutting edge part 44 of new cutter ring 41 and the position of cutting edge part 44 of cutter ring 41 after the lapse of time. As illustrated in FIG. 11, it is assumed that $A_0$ is the distance from the imaging device to cutting edge part 44 of new cutter ring 41. It is assumed that $A_n$ is the distance from the imaging device to cutting edge part 44 of cutter ring 41 after the lapse of time. A difference $(A_n - A_0)$ between the distance $A_n$ and the distance $A_0$ can be calculated as a pseudo wear amount of cutting edge part 44.

Figure 12:
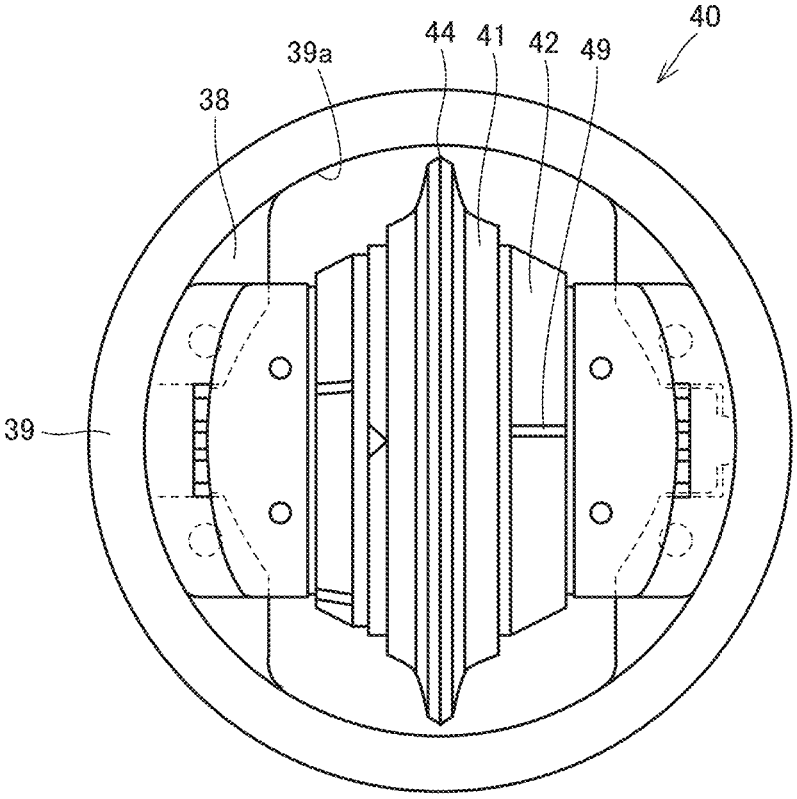
FIG. 12 is a schematic diagram illustrating an example of the means for detecting the wear amount of the cutting edge part.

FIG. 12 is a schematic diagram illustrating an example of the means for detecting the wear amount of cutting edge part 44. In FIG. 12, a front view of disc cutter 40 similar to FIG. 4 is illustrated. Any reference point may be set in a vicinity of cutting edge part 44 of cutter ring 41, and the wear amount of cutting edge part 44 may be calculated by detecting a change in distance between the reference point and cutting edge part 44. For example, the reference point may be defined on an inner circumferential surface 39*a* of accommodation unit 39 of cutter head 30 in FIG. 12. The reference point may be defined as a position closest to cutting edge part 44 of cutter ring 41 in inner circumferential surface 39*a*.

The distance between the reference point on inner circumferential surface 39*a* and cutting edge part 44 increases as cutting edge part 44 is worn. Based on the distance between cutting edge part 44 of new cutter ring 41 and the reference point and the distance between cutting edge part 44 of cutter ring 41 after the lapse of time and the reference point, the pseudo wear amount of cutting edge part 44 can be calculated by measuring the distance between cutting edge part 44 of disc cutter 40 and the reference point from the image data captured by the imaging device.

The detection of uneven wear of each disc cutter 40 will be described below. For example, sometimes cutter ring 41 does not rotate due to biting of stones, damage of bearings supporting cutter rings 41, consolidation of soil, or the like.

Unless cutter ring 41 rotates, a portion of cutting edge part 44 continues to slide with respect to the excavation surface, and the uneven wear in which only the corresponding portion of cutting edge part 44 is worn is generated. Normally cutting edge part 44 of cutter ring 41 is worn evenly in the circumferential direction. However, cutting edge part 44 is linearly worn in the case where the uneven wear is generated, so that a wear speed is much greater than that in the case of the normal wear. As a result, the wear may progress not only to cutter ring 41, but also to hub 42, the bearing, and cutter head 30.

Figure 13:
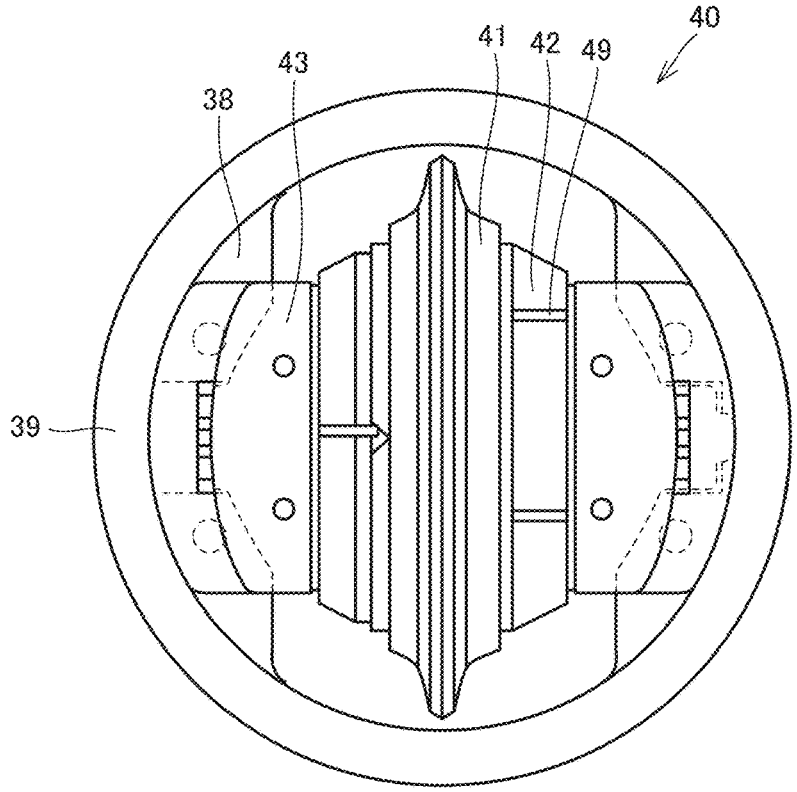
FIG. 13 is a schematic view illustrating an example of detection of uneven wear in the cutting edge part.
Figure 14:
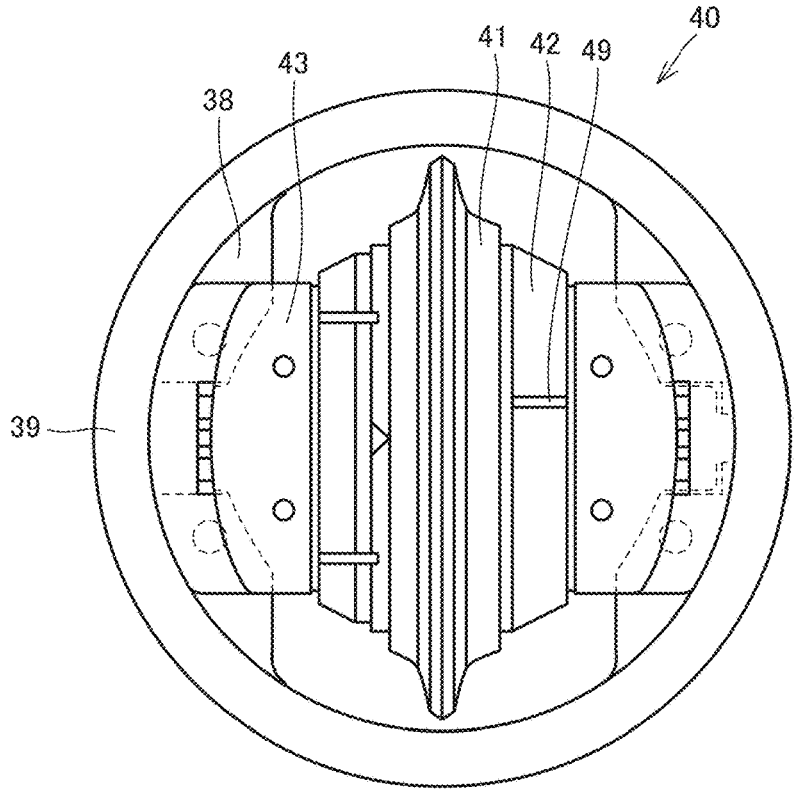
FIG. 14 is a schematic view illustrating an example of the detection of the uneven wear in the cutting edge part.

When the rotation of cutter ring 41 is checked during the excavation, it can be recognized that the uneven wear is not generated. Whether cutter ring 41 is rotating can be discriminated by recognizing the position of marking 49 formed on hub 42 in each disc cutter 40. FIGS. 13 and 14 are schematic views illustrating an example of the detection of the uneven wear in cutting edge part 44. FIG. 13 illustrates disc cutter 40 captured from the front at a certain time, and FIG. 14 illustrates disc cutter 40 captured from the front after a certain period of time elapses since the capturing of disc cutter 40 in FIG. 13. The image of disc cutter 40 in FIGS. 13 and 14 can be captured using the imaging device.

Marking 49 indicates the position of hub 42 relative to cutter head 30. The position of marking 49 formed on hub 42 of disc cutter 40 in FIG. 14 is different from the position of marking 49 in FIG. 13. The position of marking 49 changes, so that a determination that cutter ring 41 rotates can be made, and therefore it can be recognized that the uneven wear of cutting edge part 44 of cutter ring 41 is not generated.

When the position of marking 49 in FIG. 14 is located at the same position as the position of marking 49 in FIG. 13, there is a possibility that cutter ring 41 does not rotate, and it can be recognized that there is a possibility that cutting edge part 44 of cutter ring 41 is unevenly worn. The generation of the uneven wear in cutting edge part 44 of cutter ring 41 can be detected by detecting the presence or absence of the position change of disc cutter 40 relative to cutter head 30 from the image data captured by the imaging device.

Figure 15:
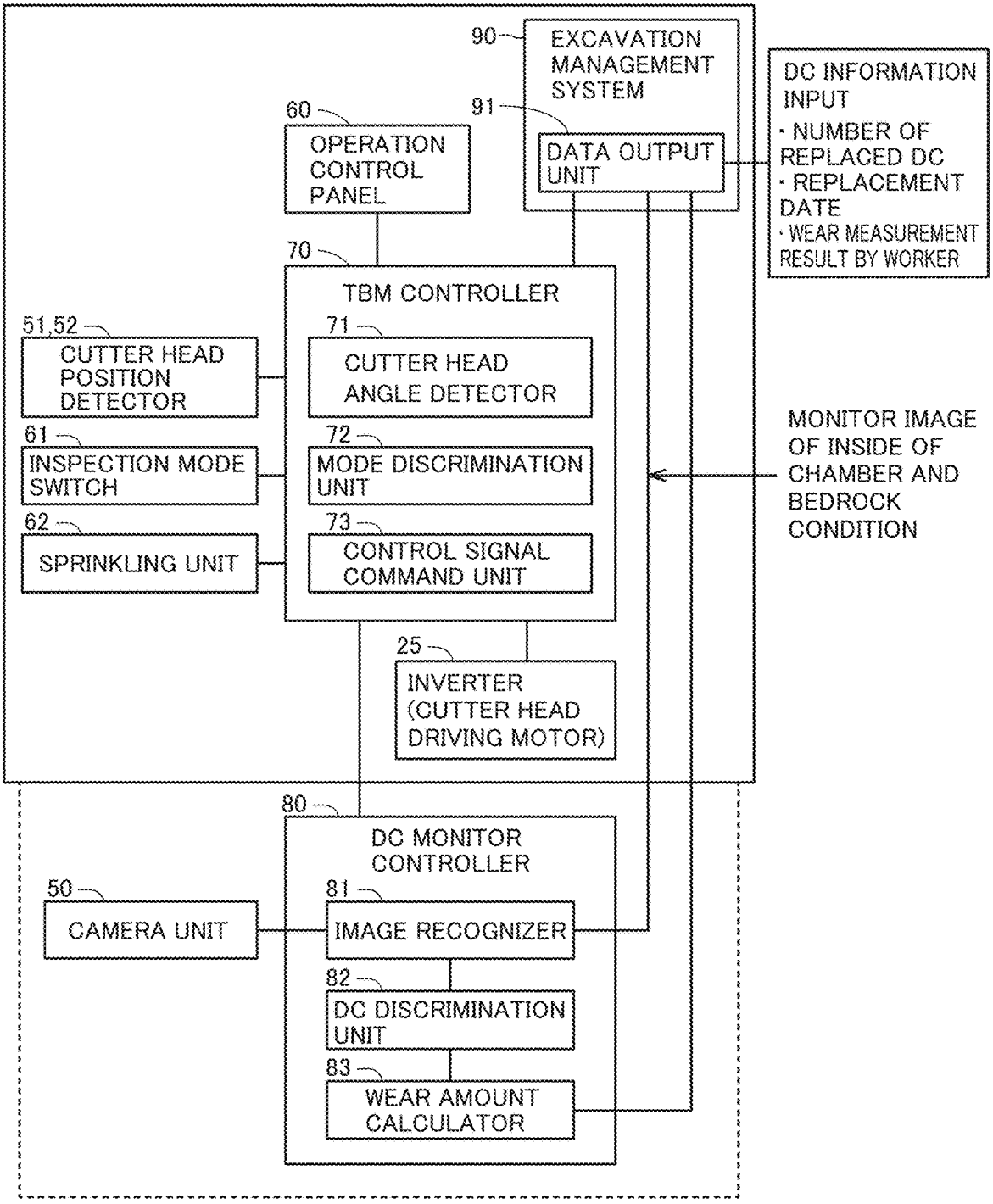
FIG. 15 is a functional block diagram illustrating a configuration of a control system of the first embodiment.

An outline of the control system of the embodiment will be described below. FIG. 15 is a functional block diagram illustrating a configuration of the control system of the first embodiment. The configuration in the rectangle indicated by a solid line in FIG. 15 illustrates the configuration similar to the control system of existing tunnel boring machine 1. The configuration in the rectangle indicated by a broken line in FIG. 15 illustrates the configuration unique to the present embodiment relating to the wear detection of disc cutter 40.

As illustrated in FIG. 15, the control system includes a TBM (Tunnel Boring Machine) controller 70, an operation control panel 60, and an excavation management system 90. TBM controller 70 controls a whole of tunnel boring machine 1. TBM controller 70 receives a signal indicating a detection result from proximity sensors 51, 52 that calculate the rotation angle of cutter head 30 described with reference to FIG. 9. TBM controller 70 includes a cutter head angle detector 71. Cutter head angle detector 71 obtains the current rotation angle of cutter head 30 based on the detection results of proximity sensors 51, 52.

Operation control panel 60 is operated by an operator. Operation control panel 60 receives an operation of the operator who operates tunnel boring machine 1.

Excavation management system 90 includes a data output unit 91. Information about the disc cutter (DC) is input to data output unit 91. For example, information indicating which disc cutter 40 is replaced, a replacement date of disc cutter 40, and the wear measurement result of cutting edge part 44 by a worker are input.

The control system also includes an inspection mode switch (SW) 61. Inspection mode switch 61 is operated by an operator. One of an inspection mode and a normal mode is selected when the operator operates inspection mode switch 61. TBM controller 70 receives input of a signal indicating which mode is selected from inspection mode switch 61. TBM controller 70 includes a mode discrimination unit 72. Based on the input from inspection mode switch 61, mode discrimination unit 72 discriminates which one of the inspection mode and the normal mode is selected. Details of the wear detection in the inspection mode and the wear detection in the normal mode will be described later.

TBM controller 70 also includes a control signal command unit 73. Control signal command unit 73 outputs a control signal instructing start, stop, a rotation speed of the motor, and the like to cutter head driving motor 25 described with reference to FIG. 8. Control signal command unit 73 also outputs a control signal instructing start of sprinkling, stop of sprinkling, a water spraying amount, and the like to a sprinkling unit 62. Sprinkling unit 62 is disposed behind cutter head 30, and sprinkling unit 62 is used in spraying water in the space on the back surface side of cutter head 30 to prevent dust or in spraying water on disc cutter 40 to wash out clay stuck to disc cutter 40.

The control system also includes a DC monitor controller 80 and a camera unit. The camera unit is constructed with the above-described imaging device. DC monitor controller 80 includes an image recognizer 81, a DC discrimination unit 82, and a wear amount calculator 83. For example, image recognizer 81 receives input of image data in FIG. 7 from the camera unit. DC discrimination unit 82 discriminates which one of the plurality of disc cutters 40 is disc cutter 40 included in the image data input to image recognizer 81. Wear amount calculator 83 calculates the wear amount of cutting edge part 44 of disc cutter 40 discriminated by DC discrimination unit 82.

Figure 16:
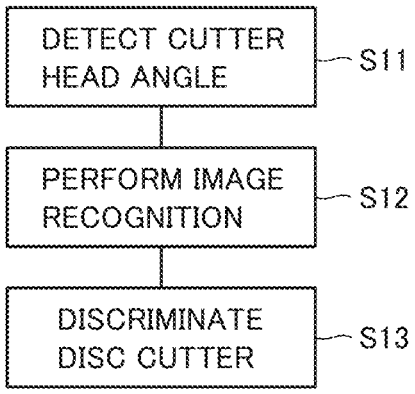
FIG. 16 is a flowchart illustrating an example of discrimination of the disc cutter.

FIG. 16 is a flowchart illustrating an example of the discrimination of disc cutter 40 by DC discrimination unit 82. As illustrated in FIG. 16, the angle of cutter head 30 is detected (step S11). Specifically, as described with reference to FIG. 9, the number of passing teeth of rotating gear 28 is detected by proximity sensor 52 with the position of cutter head 30 as the reference position (angle of 0°) when proximity sensor 51 detects projection 29. Cutter head angle detector 71 of TBM controller 70 calculates the number of passing teeth of gear 28 with respect to the number of teeth of gear 28 for the rotation of 360°, thereby detecting the rotation angle of cutter head 30.

Subsequently, the image is recognized (step S12). Image recognizer 81 of DC monitor controller 80 in FIG. 15 recognizes the image data input from the camera unit (imaging device), and recognizes disc cutter 40 included in the image data.

Subsequently, disc cutter 40 is discriminated (step S13). DC discrimination unit 82 recognizes the current rotation angle of cutter head 30, and discriminates which one of the plurality of disc cutters 40 is each disc cutter 40 in the image data captured by the imaging device based on the previously-input attaching position of each disc cutter 40 with respect to cutter head 30 and the rotation angle of cutter head 30.

Figure 17:
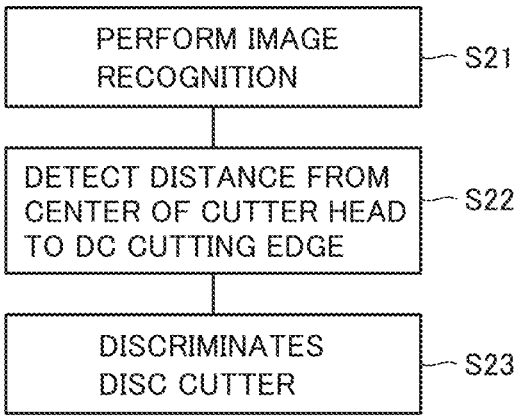
FIG. 17 is a flowchart illustrating an example of the discrimination of the disc cutter.

FIG. 17 is a flowchart illustrating another example of the discrimination of disc cutter 40 by DC discrimination unit 82. As illustrated in FIG. 17, the image is recognized (step S21). Image recognizer 81 of DC monitor controller 80 in FIG. 15 recognizes the image data input from the camera unit (imaging device), and recognizes disc cutter 40 included in the image data.

Subsequently, the distance from center line C of cutter head 30 to cutting edge part 44 of disc cutter 40 is detected (step S22). The imaging device that captures the image data is fixed to main body 10 of tunnel boring machine 1, and the relative position between the imaging device and center line C of cutter head 30 is not changed even if cutter head 30 rotates. Consequently, the distance from center line C of cutter head 30 to cutting edge part 44 is obtained by detecting the position of cutting edge part 44 of disc cutter 40 included in the image data.

Subsequently, disc cutter 40 is discriminated (step S23). As described with reference to FIG. 10, DC discrimination unit 82 discriminates which one of the plurality of disc cutters 40 is each disc cutter 40 in the image data captured by the imaging device by comparing the distance from center line C of cutter head 30 to cutting edge part 44 to the previously-input distance information about each of cutting edge parts 44 from center line C.

In the above example, disc cutter 40 is discriminated by the angle of cutter head 30 and the distance from center line C of cutter head 30 to cutting edge part 44 of disc cutter 40. Alternatively, disc cutter 40 may be discriminated based on the angle of cutter head 30 and the angle formed by the reference point and disc cutter 40.

Figure 18:
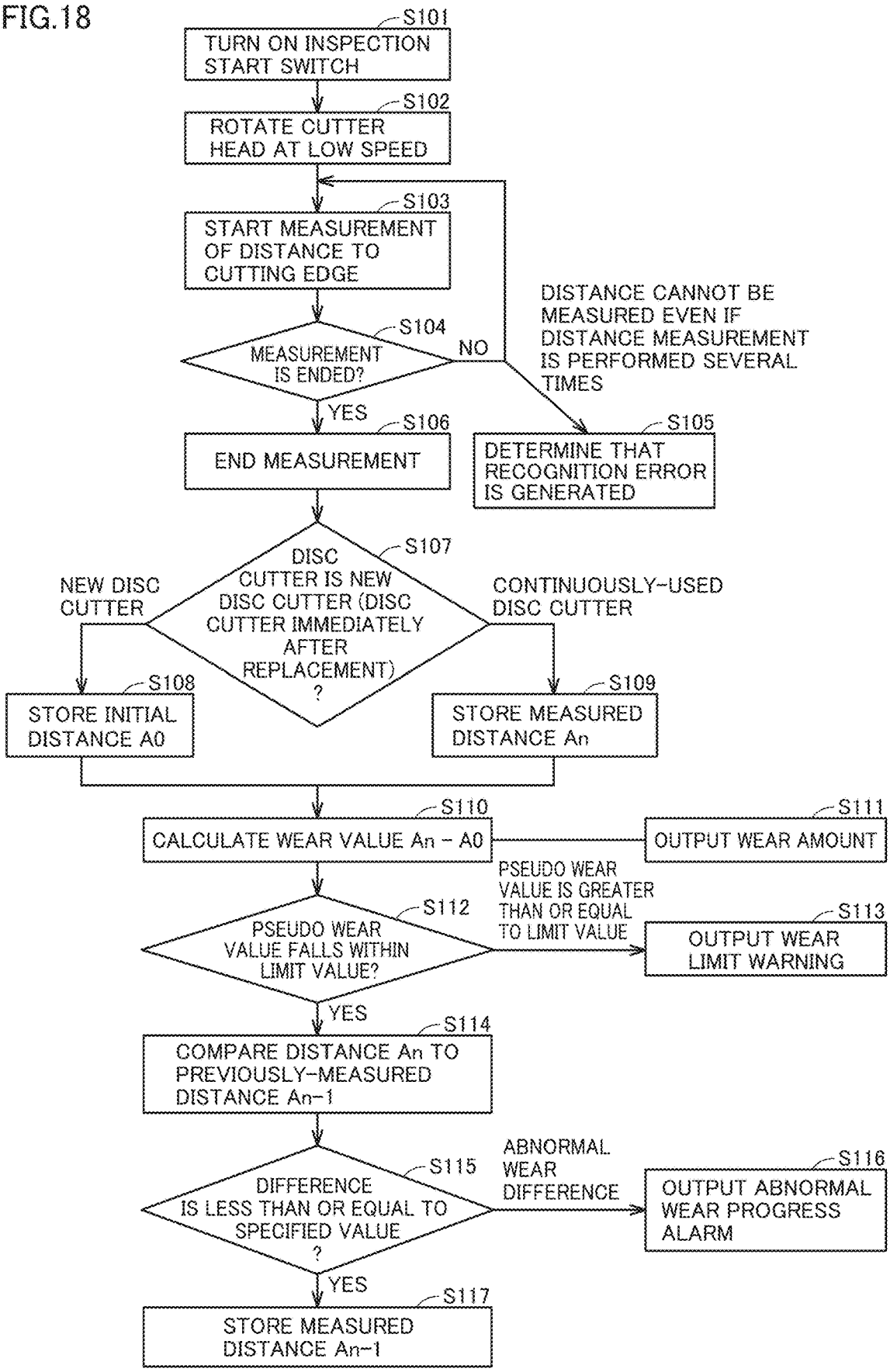
FIG. 18 is a flowchart illustrating wear amount measurement in an inspection mode.

FIG. 18 is a flowchart illustrating wear amount measurement of cutting edge part 44 in the inspection mode. The operator operates inspection mode switch 61 in FIG. 15, thereby selecting the inspection mode. The inspection mode is selected at time of daily inspection that is not being excavated, for example, before the start of work in the morning or after completion of work in the evening. Even if one of disc cutters 40 is replaced, the inspection mode is selected to perform the inspection.

The inspection start switch (SW) is turned on as illustrated in FIG. 18 (step S101). When the inspection start switch is turned on, cutter head 30 starts the rotation at a low speed without propelling (step S102). TBM controller 70 in FIG. 15 receives input of a signal indicating that the inspection start switch is turned on while the inspection mode is selected, and outputs a control signal instructing the rotation at a low speed to cutter head driving motor 25.

Subsequently, the measurement of the distance to cutting edge part 44 of disc cutter 40 is started (step S103). As described with reference to FIG. 11, the imaging device captures the images of disc cutter 40 to obtain the distance from the imaging device to cutting edge part 44 of each disc cutter 40. Alternatively, the distance from the reference point defined in the vicinity of cutting edge part 44 to cutting edge part 44 is obtained as described with reference to FIG. 12.

Subsequently, whether the measurement of the distance to cutting edge part 44 is performed without any problem is determined (step S104). When the determination that the distance measurement cannot be performed is made (NO in step S104), the distance measurement in step S103 is performed again. When the distance cannot be measured even if the distance measurement is performed several times, it is determined that a recognition error is generated (step S105). When the determination that the distance to cutting edge part 44 is measured is made (YES in step S104), the distance measurement is ended (step S106).

Subsequently, whether disc cutter 40 for which the distance to cutting edge part 44 is measured is new disc cutter 40 (disc cutter 40 immediately after replacement) is determined (step S107). DC monitor controller 80 refers to the information about disc cutter 40 input to data output unit 91 of excavation management system 90 to determine whether disc cutter 40 is new disc cutter 40.

When disc cutter 40 is determined to be new disc cutter 40 (YES in step S107), the measured distance to cutting edge part 44 is stored in the storage device as distance $A_0$ to cutting edge part 44 of new cutter ring 41 (Step S108). When disc cutter 40 is determined to be not new disc cutter 40 but be continuously used (NO in step S107), the measured distance to cutting edge part 44 is stored in the storage device as distance $A_n$ to cutting edge part 44 of cutter ring 41 after the lapse of time (step S109).

Subsequently, a pseudo wear value of cutting edge part 44 is calculated (step S110). The pseudo wear value of cutting edge part 44 is calculated as the difference $(A_n-A_0)$ between distance $A_n$ and distance $A_0$. Wear amount calculator 83 in FIG. 15 calculates the pseudo wear value of cutting edge part 44 by performing the calculation of $(A_n-A_0)$ using distance $A_0$ stored in the storage device and measured distance $A_n$. Subsequently, the calculated pseudo wear value is output (step S111).

Subsequently, whether the calculated pseudo wear value of cutting edge part 44 falls within a limit value is determined (step S112). When the pseudo wear value of cutting edge part 44 is determined to be greater than or equal to the limit value (NO in step S112), a wear limit warning is output (step S113) to notify the operator that it is time to replace disc cutter 40.

When the pseudo wear value of cutting edge part 44 falls within the limit value (YES in step S112), comparison with a previously-measured distance $A_{n-1}$ to cutting edge part 44 is performed (step S114). Wear amount calculator 83 performs the calculation of $(A_n-A_{n-1})$ to calculate the wear amount of cutting edge part 44 from the previous measurement.

Subsequently, the difference in the pseudo wear amount of cutting edge part 44 from the previous measurement is determined (step S115). When the difference from the previous measurement is determined to be greater than a specified value (NO in step S115), an abnormal wear progress alarm is output (step S116). When the difference from the previous measurement is determined to fall within the specified value (YES in step S115), the distance $A_{n-1}$ is stored in the storage device (step S117). Then, the processing is ended.

Figure 19:
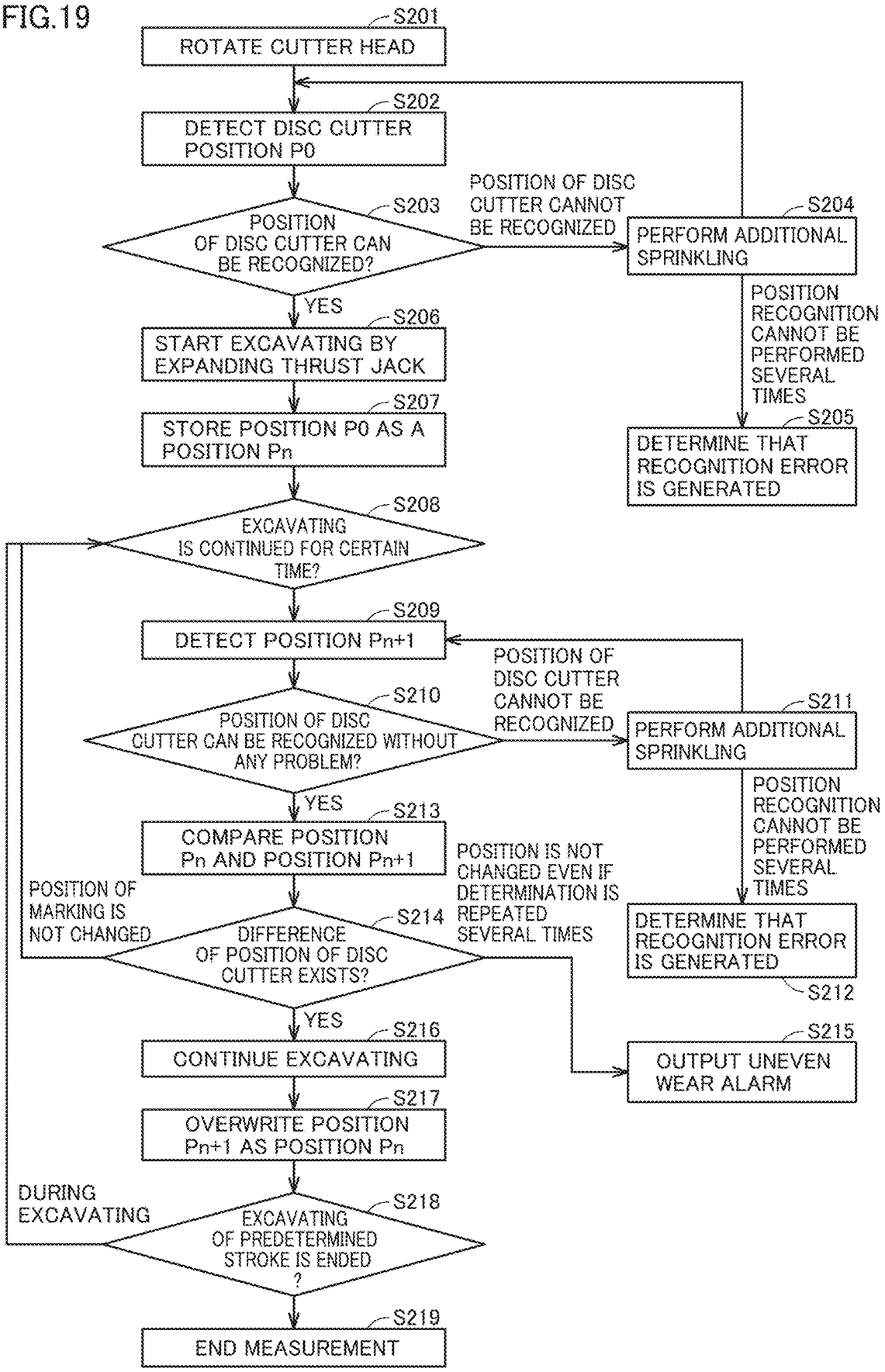
FIG. 19 is a flowchart illustrating the wear amount measurement in a normal mode.

FIG. 19 is a flowchart illustrating the wear amount measurement in the normal mode. The operator operates inspection mode switch 61 in FIG. 15, thereby selecting the normal mode. The normal mode is selected when the work to excavate the excavation surface is performed.

The cutter head 30 starts rotating as illustrated in FIG. 19 (step S201). At the time cutter head 30 starts to rotate, cutting edge part 44 of disc cutter 40 does not yet contact with the excavation surface. Consequently, cutter ring 41 and hub 42 of disc cutter 40 do not rotate. At this point, the imaging device captures the image of disc cutter 40, and a position $P_0$ indicating an initial position of marking 49 formed on hub 42 is detected (step S202).

Then, whether the initial position of disc cutter 40 can be recognized without any problem is determined (step S203). When the determination that the position recognition cannot be performed is made (NO in step S203), additional sprinkling is performed (step S204). Control signal command unit 73 in FIG. 15 outputs a control signal instructing the sprinkling to sprinkling unit 62. The sprinkling is performed to reduce dust in the space between cutter head 30 and the imaging device and to clean the soil adhering to disc cutter 40, which allows the image of disc cutter 40 to be more clearly captured.

Then, the position recognition of disc cutter 40 in step S202 is performed again. When the position recognition cannot be performed even if the measurement is performed several times, it is determined that a recognition error is generated (step S205).

When the determination that the initial position of disc cutter 40 can be recognized is made (YES in step S203), the excavation is started (step S206). Specifically, thrust jack 18 is expanded while gripper shoe 16 in FIG. 1 is pressed against the sidewall surface of the tunnel, which allows cutter head 30 and disc cutter 40 to be moved forward toward the excavation surface. Cutting edge part 44 of the outer circumferential edge of cutter ring 41 is brought into contact with the excavation surface while cutter head 30 is rotated. Cutter ring 41 rotates with respect to cutter head 30 to excavate the excavation surface.

Subsequently, position $P_0$ indicating the initial position information about marking 49 is stored in the storage device as a position $P_n$ (step S207). At this point, the excavation is continued for a certain period of time (for example, 5 minutes or 10 minutes). When the determination that the excavation is continued for a certain time is made (step S208), the image of disc cutter 40 is captured to detect a position $P_{n+1}$ indicating the current position of marking 49 formed on hub 42 (step S209).

Subsequently, whether the current position of disc cutter 40 can be recognized without any problem is determined (step S210). When the determination that the position recognition cannot be performed is made (NO in step S210), the additional sprinkling is performed (step S211). Control signal command unit 73 in FIG. 15 outputs a control signal instructing the sprinkling to sprinkling unit 62. Then, the position recognition of disc cutter 40 in step S209 is performed again. When the position recognition cannot be performed even if the measurement is performed several times, it is determined that the recognition error is generated (step S212).

When the determination that the current position of disc cutter 40 can be recognized is made (YES in step S210), the image illustrating position $P_0$ and the image illustrating position $P_{n-1}$ are compared to each other (step S213), and whether a difference of the position of marking 49 formed on disc cutter 40 exists in both the images is determined (step S214).

When the determination that the difference of the position of the marking 49 does not exist is made (NO in step S214), the processing returns to step S208, the current position of marking 49 is detected again after the excavation is further continued for a certain time, and the determination in step S214 is made again. When the position of marking 49 is not changed even if the determination in step S214 is repeated several times, an uneven wear alarm is output (step S215), and the operator is notified of a possibility that cutter ring 41 does not rotate to generate the uneven wear of cutting edge part 44.

When the determination that the difference of the position of marking 49 exists is made (YES in step S214), the excavation is continued (step S216), and position $P_{n+1}$ indicating the position information about marking 49 is overwritten as position $P_n$ (step S217).

Then, whether the excavation of a predetermined stroke is ended is determined (step S218). When the determination that the excavation of the predetermined stroke is not ended is made (NO in step S218), the processing returns to step S208, the current position of marking 49 is detected again after the excavation is continued for a certain time, and the determination in step S214 is made again.

When the determination that the excavation of the predetermined stroke is ended is made (YES in step S218), the excavation is ended and the measurement of the wear amount of cutting edge part 44 is also ended (step S219). The wear may be measured similarly to the inspection mode during normal excavation, or the uneven wear may be checked during the inspection mode.

Although some parts overlap the above description, the characteristic configurations of the present embodiment are listed as follows. As illustrated in FIGS. 5 and 6, tunnel boring machine 1 of the present embodiment includes the imaging device. The imaging device is disposed behind disc cutter 40 mounted on cutter head 30. The imaging device can capture the image of disc cutter 40 as illustrated in FIG. 7. As illustrated in FIGS. 11 and 12, the imaging device has a function as an acquisition unit that acquires the cutting edge position data indicating the position of the cutting edge part of disc cutter 40.

As illustrated in FIG. 15, tunnel boring machine 1 further includes DC discrimination unit 82 and wear amount calculator 83. As illustrated in FIGS. 16 and 17, DC discrimination unit 82 discriminates which one of the plurality of disc cutters 40 is disc cutter 40 captured by the imaging device. DC discrimination unit 82 discriminates which one of the pieces of cutting edge position data about the plurality of disc cutters 40 is the cutting edge position data captured by the imaging device. As illustrated in FIG. 18, wear amount calculator 83 calculates the wear amount of cutting edge part 44 of disc cutter 40 based on the cutting edge position data of disc cutter 40. Wear amount calculator 83 has a function as a calculator that calculates the wear amount of cutting edge part 44 of discriminated disc cutter 40.

Which one of the plurality of disc cutters 40 is disc cutter 40 captured by the imaging device can be discriminated based on the current rotation angle of cutter head 30 and/or the distance from center line C of cutter head 30 to cutting edge part 44 of disc cutter 40. The wear amount of cutting edge part 44 can be calculated with respect to discriminated disc cutter 40 by comparing the position of cutting edge part 44 at the initial stage (immediately after replacement) to the position of cutting edge part 44 after the lapse of time.

The imaging device captures the image of disc cutter 40, and the wear amount of each captured disc cutter 40 is calculated using the cutting edge position data of captured disc cutter 40, so that it is not necessary for the worker to manually measure the wear amount of disc cutter 40 one by one, but the wear amount of disc cutter 40 can efficiently be measured. Additionally, the imaging device is disposed in main body 10 of tunnel boring machine 1, and necessity for coupling the rotation side and the fixed side with wiring is eliminated. Consequently, the wear condition of disc cutter 40 can be detected with a relatively simple and highly reliable configuration.

As illustrated in FIGS. 13, 14 and 19, the imaging device has a function of acquiring rotation data indicating the position change of disc cutter 40 relative to cutter head 30, namely, the presence or absence of the rotation of disc cutter 40 with respect to cutter head 30. The two image data captured with a time interval is compared to each other to determine whether a difference of the position of marking 49 formed on hub 42 that is a rotating object exists, which allows whether cutter ring 41 of disc cutter 40 rotates with respect to cutter head 30 to be detected. A possibility that the uneven wear is generated in cutting edge part 44 can be recognized by detecting that cutter ring 41 does not rotate.

The situation in which the uneven wear is generated in cutting edge part 44 can be recognized at an early stage in this way. Consequently, the influence on hub 42 and retainer 43 of disc cutter 40, the influence on other disc cutters 40, and the influence on cutter head 30 can be prevented even if the uneven wear is generated. The unevenly-worn disc cutter 40 can be replaced, so that the situation in which the excavation performance is deteriorated can be avoided by replacing unevenly-worn disc cutter 40 at an early stage.

As illustrated in FIGS. 5 and 6, the imaging device is attached to main body 10 of tunnel boring machine 1. Although it is also conceivable to transmit and receive signals between the rotation side and the fixed side by wireless communication in the configuration in which the large number of sensors are provided on the rotatable cutter head as described in PTL 1, the problems of the cost increase in association with the provision of the sensor in each disc cutter, stability of communication, and the damage of the sensor installed in the cutter head still remain. On the other hand, in the present embodiment, one imaging device or several imaging devices are attached to main body 10 of tunnel boring machine 1. The wear condition of disc cutter 40 can surely be detected with a simple configuration by attaching the imaging device to main body 10 that is a non-rotating body.

As illustrated in FIG. 6, the imaging device is the stereo camera including first imager 53 and second imager 54. Consequently, the cutting edge position data and/or the rotation data of disc cutter 40 can be acquired from the image data captured by the stereo camera.

As illustrated in FIGS. 18 and 19, the imaging device captures the images of the plurality of disc cutters 40 during the rotation of cutter head 30. It is not necessary to stop cutter head 30 in order to calculate the wear amount of disc cutter 40 or to detect the uneven wear. Consequently, the wear of disc cutter 40 can efficiently be detected. When the uneven wear of disc cutter 40 is generated during the excavation, the generation of the uneven wear can quickly be recognized, so that the progress of the uneven wear can surely be prevented.

As illustrated in FIG. 7, the imaging device simultaneously captures the images of at least two disc cutters 40. The images of at least two disc cutters 40 are simultaneously captured by the imaging device, and the wear amount is calculated using the cutting edge position data about each captured disc cutter 40, which allows the wear amounts of many disc cutters 40 to be efficiently measured.

As illustrated in FIG. 11, the imaging device has a function as a distance measurement device that measures the distance from the imaging device to cutting edge part 44. The cutting edge position data of disc cutter 40 can be acquired by the measurement with the distance measurement device.

As illustrated in FIGS. 3 and 4, disc cutter 40 further includes hub 42 that rotates integrally with cutter ring 41, hub 42 includes marking 49, and the imaging device acquires the rotation data based on the position of marking 49. Consequently, the presence or absence of the rotation of cutter ring 41 with respect to cutter head 30 can surely be detected by determining whether the position of marking 49 changes after a lapse of a constant time.

As illustrated in FIG. 19, the uneven wear alarm is output when the imaging device acquires the rotation data indicating that disc cutter 40 does not rotate. As a result, the operator can surely recognize the possibility that the uneven wear is generated in cutting edge part 44, so that the progress of the uneven wear can be prevented.

As illustrated in FIGS. 10 and 17, disc cutter 40 is discriminated by detecting the distance from center line C of cutter head 30 to cutting edge part 44 of disc cutter 40. In this case, which one of the plurality of disc cutters 40 is captured disc cutter 40 can be discriminated by recognizing the position of center line C that is the rotation center of cutter head 30 and the position of cutting edge part 44 captured by the imaging device.

As illustrated in FIGS. 8, 9, and 16, disc cutter 40 is discriminated by detecting the rotation angle of cutter head 30. In this case, which one of the plurality of disc cutters 40 is captured disc cutter 40 can be discriminated based on the rotation angle of cutter head 30 and the information about the disposition of disc cutter 40 in cutter head 30.

The imaging device of the present embodiment simultaneously captures the images of the plurality of disc cutters 40, but the present invention is not limited thereto. The imaging device may capture the image of one disc cutter 40 at a certain time, and capture the image of another disc cutter 40 at another time by the rotation of cutter head 30.

Second Embodiment

Figure 20:
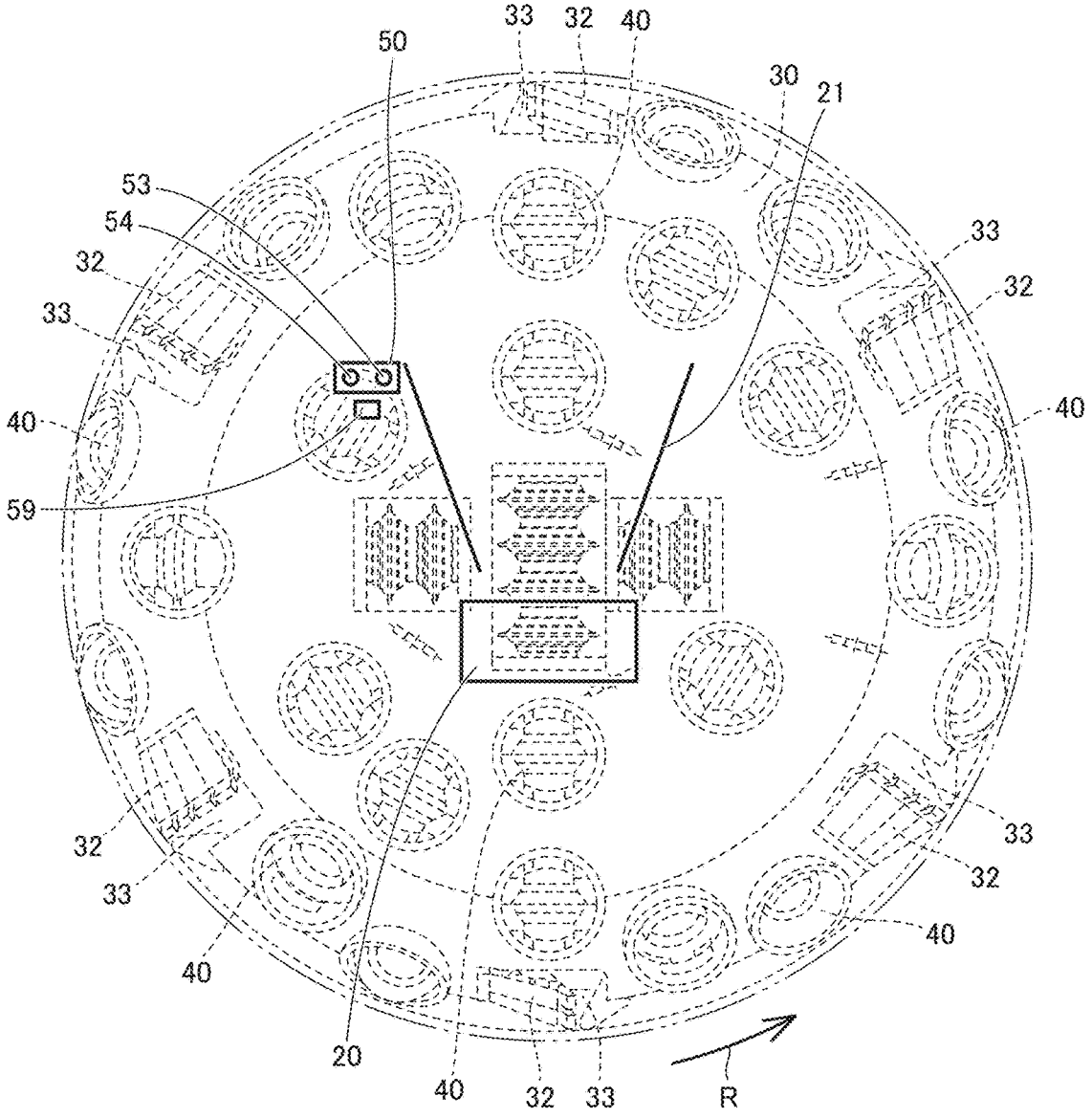
FIG. 20 is a schematic diagram schematically illustrating an internal structure of a tunnel boring machine, according to a second embodiment, when viewed from the front.

FIG. 20 is a schematic diagram schematically illustrating an internal structure of a tunnel boring machine 1, according to a second embodiment, when viewed from the front. In addition to the configuration of the first embodiment, tunnel boring machine 1 of the second embodiment further includes a temperature detector 59. As illustrated in FIG. 20, temperature detector 59 is disposed in the vicinity of the imaging device. Temperature detector 59 is disposed immediately below the imaging device. Temperature detector 59 is disposed on the front side in rotation direction R of cutter head 30 with respect to hopper chute 21.

Temperature detector 59 is configured so as to be able to detect a temperature in cutter head 30. In generating the uneven wear of cutting edge part 44 of disc cutter 40, a temperature in cutter head 30 in the space substantially closed by the excavation surface, the rear wall, and cutter head 30 rises due to frictional heat generated by continuous slide of a part of cutting edge part 44 with respect to the excavation surface. The situation in which the uneven wear is generated in cutting edge part 44 can be estimated by detecting the temperature in cutter head 30 using temperature detector 59. When abnormal temperature rise is detected in cutter head 30, the uneven wear alarm is output similarly to the first embodiment described with reference to FIG. 19, and the operator can be notified of the possibility that cutter ring 41 does not rotate to generate the uneven wear of cutting edge part 44.

The disposition of temperature detector 59 in FIG. 20 is by way of example, and temperature detector 59 may be disposed at any position as long as the temperature in cutter head 30 can be detected.

Tunnel boring machine 1 may further include a sound level meter that can detect a noise in the space behind cutter head 30 separately from or in addition to temperature detector 59. In generating the uneven wear of cutting edge part 44 of disc cutter 40, a part of cutting edge part 44 continues to slide with respect to the excavation surface, thereby generating the noise. The situation in which the uneven wear is generated in cutting edge part 44 can be estimated by detecting the generation of the noise using the sound level meter.

Third Embodiment

Figure 21:
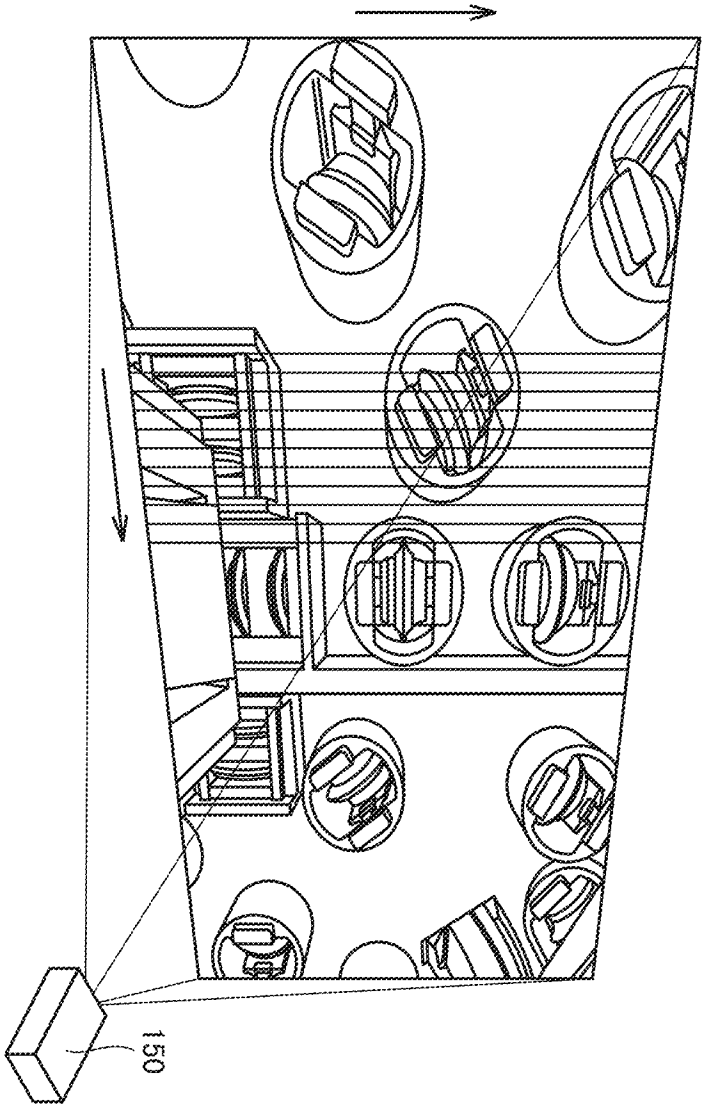
FIG. 21 is a schematic diagram illustrating a scanning condition of the cutter head by a laser scanner in a third embodiment.

FIG. 21 is a schematic diagram illustrating a scanning condition of cutter head 30 by a laser scanner 150 in a third embodiment. Instead of the imaging device described above, tunnel boring machine 1 may include laser scanner 150. Laser scanner 150 may be disposed at the same position as the imaging device. As illustrated in FIG. 21, laser scanner 150 is configured to be able to scan disc cutter 40. Laser scanner 150 may be configured to be able to continuously scan the plurality of disc cutters 40.

It is possible to accurately detect the distance from laser scanner 150 to cutting edge part 44 by measuring the time from when a laser beam is emitted from laser scanner 150 to when the laser beam is reflected by disc cutter 40 and returned to laser scanner 150. The wear amount of cutting edge part 44 can be calculated by calculating the difference between the distance from laser scanner 150 to cutting edge part 44 of new cutter ring 41 and the distance from laser scanner 150 to cutting edge part 44 of cutter ring 41 after the elapse of time.

Based on the difference of the position of marking 49, the uneven wear of cutting edge part 44 of cutter ring 41 can be detected by adjusting marking 49 formed on hub 42 to a shape and size that can be detected by laser scanner 150.

The image is not necessarily required for the measurement of the distance from laser scanner 150 to cutting edge part 44. However, image data corresponding to the image data captured by the imaging device in FIG. 7 can be acquired by imaging point group data of cutter head 30 and disc cutter 40 measured by laser scanner 150.

The imaging device of the first embodiment and laser scanner 150 in FIG. 21 can be used in combination. For example, the wear amount of cutting edge part 44 in the inspection mode in FIG. 18 may be calculated with a distance meter in which laser scanner 150 is used, and the generation of the uneven wear in the normal mode in FIG. 19 may be detected with the imaging device.

Although tunnel boring machine 1 having a configuration illustrated schematically in FIG. 1 is what is called an open type TBM, the present invention is not limited to an open type TBM, but the present invention can also be applied to a mud pressure type shield machine or a slurry pressure type shield machine. In the mud pressure type shield machine or the slurry pressure type shield machine, the wear amount of cutting edge part 44 can similarly be measured while the soil in the machine is removed during the stop of the machine.

Although the embodiments of the present invention are described above, it should be considered that the disclosed embodiments are an example in all respects and not restrictive. The scope of the present invention is defined by not the above description, but the claims, and it is intended that all modifications within the meaning and scope of the claims are included in the present invention.

INDUSTRIAL APPLICABILITY

The tunnel boring machine of the present invention can particularly and advantageously be applied to a tunnel boring machine that excavates a hard rock layer.

REFERENCE SIGNS LIST

1: tunnel boring machine, 10: main body, 20: belt conveyor, 21: hopper chute, 22: cutter head support, 23: main bearing, 25: cutter head driving motor, 26: speed reducer, 27: pinion, 28: gear, 29: projection, 30: cutter head, 32: scraper bucket, 33: taking port, 37: accommodation space, 38: fixture, 39: accommodation unit, 39*a*: inner circumferential surface, 40: disc cutter, 41: cutter ring, 42: hub, 43: retainer, 44: cutting edge part, 47: fixing member, 49: marking, 50: measurement device, 51, 52: proximity sensor, 53: first imager, 54: second imager, 59: temperature detector, 60: operation control panel, 61: inspection mode switch, 62: sprinkling unit, 70: controller, 71: cutter head angle detector, 72: mode discrimination unit, 73: control signal command unit, 80: monitor controller, 81: image recognizer, 82: discrimination unit, 83: wear amount calculator, 90: excavation management system, 91: data output unit, 150: laser scanner, C: center line, R: rotation direction

The invention claimed is:

1. A tunnel boring machine comprising:

a main body, the main body being a non-rotating body;

a cutter head that is disposed in front of the main body and is rotatable with respect to the main body;

a plurality of disc cutters rotatably mounted on the cutter head, each of the disc cutters including a cutter ring that is exposed to a front surface of the cutter head while exposed to a back surface of the cutter head, the cutter ring including a cutting edge part;

an acquisition unit that is attached to the main body behind the cutter head and disposed behind the plurality of disc cutters to acquire cutting edge position data indicating a position of the cutting edge part of one of the disc cutters;

a discrimination unit for discriminating which one of the plurality of disc cutters is the disc cutter for which the cutting edge position data is acquired by the acquisition unit; and a calculator for calculating a wear amount of the cutting edge part of the disc cutter discriminated by the discrimination unit based on the cutting edge position data acquired for the disc cutter.

2. The tunnel boring machine according to claim 1, wherein the acquisition unit includes at least one of a stereo camera that can capture an image of the disc cutter or a laser scanner that scans the disc cutter, and acquires the cutting edge position data from image data captured by the stereo camera or acquires the cutting edge position data by measurement with the laser scanner.

3. The tunnel boring machine according to claim 2, wherein the acquisition unit includes the stereo camera and the stereo camera captures the image of the disc cutter during the rotation of the cutter head.

4. The tunnel boring machine according to claim 2, wherein the acquisition unit includes the stereo camera and the stereo camera simultaneously captures images of at least two disc cutters of the plurality of disc cutters.

5. The tunnel boring machine according to claim 1, wherein the acquisition unit includes a distance measurement device that measures a distance from the acquisition unit to the cutting edge part of the disc cutter, and the acquisition unit acquires the cutting edge position data for the disc cutter by measurement with the distance measurement device.

6. The tunnel boring machine according to claim 1, further comprising a temperature detector for detecting a temperature in the cutter head, wherein the temperature detector can detect abnormal temperature rise in the cutter head.

7. The tunnel boring machine according to claim 1, wherein the discrimination unit detects distance from a center of the cutter head to the cutting edge part of each of the plurality of disc cutters and uses the detected distances to discriminate the disc cutter for which the cutting edge position data is acquired.

8. The tunnel boring machine according to claim 1, wherein the discrimination unit discriminates the disc cutter for which the cutting edge position data is acquired by detecting a rotation angle of the cutter head with respect to the main body.

9. A tunnel boring machine comprising:

a main body, the main body being a non-rotating body;

a cutter head that is disposed in front of the main body and is rotatable with respect to the main body;

a plurality of disc cutters rotatably mounted on the cutter head, each of the disc cutters including a cutter ring that is exposed to a front surface of the cutter head while exposed to a back surface of the cutter head;

an acquisition unit that is attached to the main body behind the cutter head and disposed behind the plurality of disc cutters to acquire rotation data indicating presence or absence of rotation of one of the disc cutters with respect to the cutter head, wherein the rotation data is acquired by imaging or scanning the disc cutter; and a discrimination unit for discriminating which one of the plurality of disc cutters is the disc cutter for which the rotation data is acquired by the acquisition unit.

10. The tunnel boring machine according to claim 9, wherein the acquisition unit includes at least one of a stereo camera that can capture an image of the disc cutter or a laser scanner that scans the disc cutter, and acquires the rotation data from image data captured by the stereo camera or acquires the rotation data by measurement with the laser scanner.

11. The tunnel boring machine according to claim 10, wherein the acquisition unit includes the stereo camera and the stereo camera captures the image of the disc cutter during the rotation of the cutter head.

12. The tunnel boring machine according to claim 10, wherein the acquisition unit includes the stereo camera and the stereo camera simultaneously captures images of at least two disc cutters of the plurality of disc cutters.

13. The tunnel boring machine according to claim 9, wherein an alarm is output when the rotation data acquired by the acquisition unit indicates that the disc cutter does not rotate.

14. The tunnel boring machine according to claim 9, further comprising a temperature detector for detecting a temperature in the cutter head, wherein the temperature detector can detect abnormal temperature rise in the cutter head.

15. The tunnel boring machine according to claim 9, wherein the discrimination unit discriminates the disc cutter for which the rotation data is acquired by detecting a rotation angle of the cutter head with respect to the main body.

16. A tunnel boring machine comprising:

a main body, the main body being a non-rotating body;

a cutter head that is disposed in front of the main body and is rotatable with respect to the main body;

a plurality of disc cutters rotatably mounted on the cutter head, each of the disc cutters including a cutter ring that is exposed to a front surface of the cutter head while exposed to a back surface of the cutter head, the cutter ring including a cutting edge part;

an acquisition unit that is attached to the main body behind the cutter head and disposed behind the plurality of disc cutters to acquire (i) cutting edge position data indicating a position of the cutting edge part of one of the disc cutters and (ii) rotation data indicating presence or absence of rotation of the one disc cutter with respect to the cutter head;

a discrimination unit for discriminating which one of the plurality of disc cutters is the disc cutter for which the cutting edge position data and the rotation data are acquired by the acquisition unit; and a calculator for calculating a wear amount of the cutting edge part of the disc cutter discriminated by the discrimination unit based on the cutting edge position data acquired for the disc cutter.

* * * * *